US007407162B2

(12) United States Patent
Cockrell, Jr.

(10) Patent No.: US 7,407,162 B2
(45) Date of Patent: Aug. 5, 2008

(54) CARD GAME

(75) Inventor: Larry R. Cockrell, Jr., Kenosha, WI (US)

(73) Assignee: Innovative Gaming Inc., Kenosha, WI (US)

( * ) Notice: Subject to any disclaimer, the term of this patent is extended or adjusted under 35 U.S.C. 154(b) by 340 days.

(21) Appl. No.: 11/224,261

(22) Filed: Sep. 12, 2005

(65) Prior Publication Data

US 2007/0057464 A1 Mar. 15, 2007

(51) Int. Cl.
*A63F 1/00* (2006.01)

(52) U.S. Cl. ..... 273/292; 273/274; 463/12

(58) Field of Classification Search ..... 273/292, 273/274, 309; 463/12, 13
See application file for complete search history.

(56) References Cited

U.S. PATENT DOCUMENTS 5,174,579 A * 12/1992 Griffiths ..... 273/292
5,314,193 A 5/1994 Ferrer
5,368,305 A 11/1994 Rodda et al.
6,113,102 A 9/2000 Marks et al.
6,179,291 B1 1/2001 Vancura
6,582,302 B2 * 6/2003 Romero ..... 463/12
6,626,433 B2 9/2003 Scibetta
6,634,645 B1 10/2003 Yuan
6,637,746 B1 10/2003 Baranauskas
6,726,427 B2 4/2004 Jarvis et al.
6,776,416 B1 8/2004 Jackson
6,808,173 B2 10/2004 Snow
6,866,267 B1 3/2005 Hesse
6,874,786 B2 4/2005 Bruno et al.
6,877,745 B1 4/2005 Walker et al.
2003/0151200 A1 * 8/2003 Lee ..... 273/292
2004/0127277 A1 * 7/2004 Walker et al. ..... 463/16
2004/0222592 A1 11/2004 Stern
2005/0057000 A1 3/2005 Dreaper et al.
2005/0181878 A1 8/2005 Danieli et al.
2005/0193209 A1 9/2005 Saunders et al.

OTHER PUBLICATIONS

As Easy As 1-2-3, "Making a Champion?" 2004. 12 pages. <http://www.aseasyas123.org/making_a_champion.htm>.

* cited by examiner

*Primary Examiner*—Benjamin H Layno
(74) *Attorney, Agent, or Firm*—Jansson Shupe & Munger Ltd.

(57) ABSTRACT

A card game with a Dealer and at least one player, the game using at least one deck of standard playing cards, including dealing a hand of a first face-up card to each player and a face-down card to the Dealer, and dealing at least one additional card to each hand unless the corresponding hand has a value of a target number achievable by one card, the objective of the card game being to achieve a hand with a value of the target number, allowing one discard, where face cards and aces each have a value of one, and where a post-discard hand value greater than the target number is a Bust. When a player's hand is a Bust, that player may be given the option to wager an additional amount, where a subsequent Dealer Bust hand results in that player winning her original wager plus the additional amount.

27 Claims, 22 Drawing Sheets

CARD GAME

FIELD OF THE INVENTION

The invention relates generally to a card game and, more particularly, to a new card game suitable as an alternative to blackjack.

BACKGROUND

The gaming industry has historically provided exciting leisure activity and has been a popular source of revenue and jobs for communities that promote casinos and riverboats. Such establishments typically have card tables that may be customized for particular games such as blackjack, poker, etc. Casino type card games may be played with standard fifty-two card decks, and games such as blackjack may be played with several standard decks assembled in a shoe. Various methods may be employed for shuffling.

Poker games may or may not include a separate dealer who does not receive a hand but merely distributes cards to each active player hand. In private poker games, the deal may shift between players for each hand. By comparison, in blackjack, a "Dealer" acts as an agent of the casino or "house," and deals herself a hand in each game. Each player then plays her hand against the hand of the Dealer. Further details of standard casino type blackjack are not described herein because such details are well known to those skilled in the art. Typical variations of blackjack may include "house rules," including options for player side bets, wager increases, payoff amounts or percentage, Hit options, hand splitting, etc., and may include separate rules for how the Dealer must play her hand, such as by specifying when the Dealer is required to stand, etc. The Dealer wins, loses, or ties individually against each player's hand. House rules may permit a player to play more than one hand at a time. Each player hand is wagered against the hand of the Dealer, where the wager is collected by the Dealer if the Dealer's hand wins, and where the Dealer pays to the player an amount equal to the player's wager if the Dealer loses to that particular player.

Casino type games may be played as a social activity among live participants using actual cards, or may be played on automated machines such as those known generically as "video poker" type games or as "video slots." A casino type game may also be played on one or more cellular telephones, as an interactive internet game, as a computer software program, on a stand-alone hand-held unit such as a GAMEBOY™ unit, as a pre-installed game in a computer operating system, and in various other formats and media such as three-dimensional movie facilities, portable multi-function communication devices, and others.

There is a need for new casino type games suitable for being played in gaming establishments and in other interactive situations.

SUMMARY

In one aspect of the invention, a card game provides each player and a Dealer with an objective of achieving a hand with a value equal to a predetermined target number, allowing one discard.

According to another aspect of the invention, a method is provided for playing a card game with a Dealer and at least one player, the game using at least one deck of standard playing cards, the method including the steps of (a) designating a target number achievable by one card, (b) dealing a hand of a first face-up card to each player and a face-down card to the Dealer, (c) if a player's first face-up card is less than the target number, dealing additional face-up cards to that hand until the total is greater than or equal to the target number, (d) if a player's first face-up card is greater than the target number, dealing a second face-up card to that hand, (e) discarding one card from each player's hand having a total greater than the target number, (f) analyzing all resultant player hands, where:

(f1) a hand having a total greater than the target number after a discard has been made is a Bust;

(f2) a player's hand having a total less than the target number may Hit so long as that hand's total is less than the target number; and (f3) a hand having a total equal to the target number must Stand, (g) dealing as many face-up Hit cards as requested to any player's hand meeting (f2), (h) turning the Dealer card face up and addressing the Dealer hand according to steps (c-e) and, in addition, requiring the Dealer to Hit when the Dealer hand total is less than or equal to a predetermined threshold number, and requiring the Dealer to Stand when the Dealer hand total is greater than the predetermined threshold number, and (i) determining a winner between each player hand and the Dealer hand, where face cards and aces each have a value of one and numbered cards each have a value equal to their respective number, and where a post-discard hand value greater than the target number is a Bust.

According to a further aspect of the invention, a method is provided for playing a card game with a Dealer and at least one player, using at least one deck of standard playing cards having no jokers, the method including (a) designating a target number achievable by one card, (b) dealing a hand of a single face-up card to each player and a single face-down card to the Dealer, (c) analyzing all player hands from step (b), where:

(c1) any hand that matches the target number is designated a "Quick";

(c2) any hand less than the target number is eligible for a Hit; and (c3) any hand greater than the target number requires a discard and a Hit, (d) allowing each hand eligible for a Hit to receive as many Hits as requested so long as that hand's total is less than the target number, (e) allowing each hand having a total greater than the target number to discard one card, with a maximum one discard per hand, (f) resolving all player hands according to steps (c-e), (g) turning the Dealer card face up and resolving the Dealer hand according to steps (c1-e), and (h) determining a winner between each player hand and the Dealer hand, where face cards and aces each have a value of one and numbered cards each have a value equal to their respective number, and where a post-discard hand value greater than the target number is a Bust.

In another aspect of the invention, a method is provided for playing a wagering card game with a Dealer and at least one player who has made a wager, the game using at least one deck of standard playing cards having no jokers, the method comprising when a player's hand is a Bust, giving that player the option to wager an additional amount, where a subsequent Dealer Bust hand results in that player winning her original wager plus the additional amount.

In still another aspect of the invention, a method is provided for playing a wagering card game with a Dealer and at least one player who has made a wager, the game using at least one deck of standard playing cards, the method including designating a target number achievable by one card, if a first card of a hand is less than the target number, dealing additional face-up cards to that hand until the total is greater than or equal to the target number, and requiring that each player discard one card when that player's hand exceeds the target number.

The foregoing summary does not limit the invention, which is defined by the attached claims. Similarly, neither the Title nor the Abstract is to be taken as limiting in any way the scope of the disclosed invention.

BRIEF DESCRIPTION OF THE DRAWING FIGURES

DETAILED DESCRIPTION OF PREFERRED EMBODIMENTS

Figure 1:
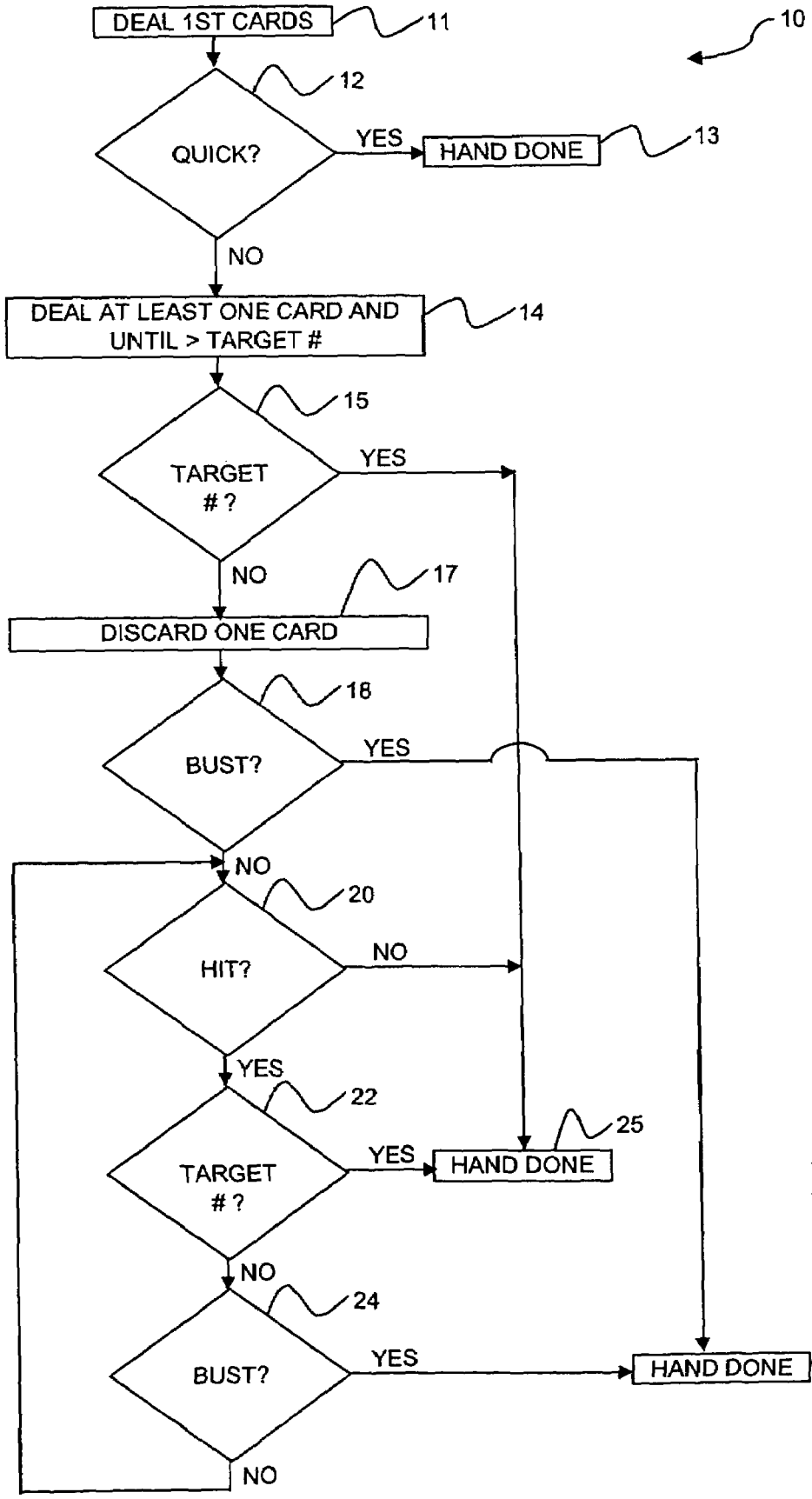
FIG. 1 is a flow chart for a dealing procedure used for dealing a hand of a player, according to an exemplary embodiment of the invention.

In the context of the subject invention, various terms are used as now explained. "Players" who play the game may be any number, and a physical casino type table will accommodate from one to six or seven people, depending on the table design and layout. In a typical gaming situation, players are considered to be those persons at a table who have placed a wager. The "deck" used for playing the game is a standard deck of playing cards, and any number of standard decks may be used in a game for improving the random nature of a given hand. Jokers are preferably not used. "Values" of individual cards are used for evaluating a hand's total value, where all numbered cards have a value equal to their respective face number, and where all face cards and aces each have a value of one.

The play scenario is similar to blackjack in that each player is playing against the hand of a Dealer. A "payout" is an amount a player wins, typically equal to the amount the player waged on the particular hand. In a gaming situation, house rules typically require that a player's wager be no less than a table minimum and no more than a table maximum.

In several of the disclosed embodiments, a "Discard" is an option for a given player or for the Dealer, depending on the particular situation. Only one Discard is allowed per hand if the hand totals higher than the target number. A hand receiving an initial card having a value greater than the target number is an automatic Discard (although such an initial card may be later retained when playing a version of the game that allows a "Hazard Bet"). In an exemplary table game, a Discard action is when a player or Dealer physically removes a chosen card from their hand, such as by sliding the one card forward.

In the described embodiments, a "Quick" occurs when a player or Dealer's first card is equal to the game's target number. For example, in a game of QUICK SEVEN™, a target number is seven, and a Quick occurs when a player or Dealer's first card is a seven.

A "Natural" occurs when a hand receives a second card equal to the target number. In the example of QUICK SEVEN, when a given hand receives a first card that is not a seven, the hand subsequently receives a second card. When that second card is a seven, the first card may be discarded. As a result, the hand is termed a "Natural Seven."

A "Soft" occurs when a combined total of cards in a hand equals the target number. In the example of QUICK SEVEN, when a given hand has a plurality of cards that total seven, either after or without a Discard, the hand is termed a "Soft Seven."

A "normal hand," as that term is used herein, is a player hand where the player Stands on any total for her hand that is less than the target number.

A "Hit" is an additional card dealt to a hand after a Discard. A Hit is optional for a player's hand and is preferably determined by house rules for the Dealer. In the example of QUICK SEVEN, when a player has a Discard and a remaining hand of one, two, three, four, five, or six, that player may request a Hit. If such Hit results in a new total for the hand of less than seven, the player may request another Hit. The player may continue to request a Hit until her hand totals seven or more. If the player is satisfied with her hand, she will decline another Hit. For the Dealer, a decision whether to Hit a hand is preferably dependent on house rules. In the example of QUICK SEVEN, a predetermined threshold number may be used, for example "four." In such a case, when the Dealer's hand totals greater than four, after a Discard, the house rules may require the Dealer "Stand" without having a choice of receiving a Hit. When such hand has a total value of four or less, the Dealer may be required to take a Hit by the house rules. Various house rules may be used for establishing the Dealer Hit options, or lack thereof, for given game. A "Stand" is either when a player chooses to forego receiving a Hit, or when the Dealer is required or elects to forego a Hit.

A "Bust" is a hand totaling higher than the target number after a discard has been made. In the example of QUICK SEVEN, a Bust hand has a value greater than seven after a Discard. A "Dealt Bust" is a Bust hand resulting from two consecutive dealt cards being higher than the target number. In QUICK SEVEN, a Dealt Bust, for example, is a hand receiving consecutive 8, 9, or 10 cards in any combination.

A "Push" is a situation where a player's hand and the Dealer's hand have a tie value. The result of a Push depends on house rules. For example, local rules may state that the Dealer wins a Push for certain scenarios, or may state that a player wins in certain scenarios, or may state that a Push is a tie for some or all scenarios. In such a case, an existing wager may remain for a subsequent hand, or may be increased for the subsequent hand, depending on house rules.

A "Bonus" is a percentage of a player's wager that is paid immediately to a player having a Quick. For example, in various embodiments, a player whose first card matches the target number has a Quick, and that player immediately receives a Bonus percentage of her original bet. The payout percentage for the Bonus can vary among different casinos. The Dealer may then give the player the option to Press or Hold her Bonus.

A "Press" is when a player who just received a Bonus for having a Quick chooses to bet their Bonus on the current hand. For example, the player may place her Bonus on the line of the wager circle to indicate a Press. Alternatively, the player can simply add the Bonus to her stack of chips on her wager circle. If the player's hand then beats the Dealer's hand, the player's winnings are equal to her combined bet. If the Dealer's hand is a Quick, Soft, or Natural, then the player loses her combined bet of her original wager and her Bonus. A "Hold" is when a player keeps her Bonus and does not Press.

Rules of the game are established for players and for the Dealer.

An example of player rules is now described for a game of QUICK SEVEN, where the number seven is the target number. Each player has the objective of achieving a hand with a value of seven, allowing one Discard. After a Discard, the player's goal is to have a hand with a value of seven or a hand as close as possible to seven without exceeding seven. A hand exceeding seven after a Discard is a Bust. If a player's hand has a value of seven (Quick Seven, Natural Seven, Soft Seven), playing of the hand is over.

If a player's first card is six or less, additional card(s) are dealt to the player until her hand (1) totals seven, or (2) totals higher than seven. If the hand then totals seven, it is a Soft Seven. If the hand totals higher than seven, the player slides her first card forward (Discard or potential Hazard Bet) and receives a second card. Thereafter, the player may choose to Stand or Hit as many times as they choose, so long as their total remains less than seven. If the player has a Bust, they lose the hand, even if the Dealer subsequently gets a Bust (unless a Hazard Bet is part of the house rules).

If the player's first card is an 8, 9, or 10, that card is slid forward (or designated a Discard by any manner by either the player or Dealer) and the player's hand receives a second card. If the hand is not a Bust, the player may continue to Hit as many times as the player requests so long as the hand has a value less than seven. If the player exceeds seven after the Discard, the hand is a Bust. If both the of the first two cards are 8, 9, or 10, the hand is termed a "Dealt Bust" that may be eligible for Hazard Bet, if applicable. Unless otherwise specified, a Dealt Bust is included hereafter in descriptions as a subset of Busts.

Between the player and the Dealer, whoever has a seven or is closest to seven wins. If the player and Dealer tie, the hand is a Push.

An example of Dealer rules is now described for a game of QUICK SEVEN. The Dealer uses the same rules as each player, except when determining the Discard. The Dealer has to keep the high card or the high total of their hand, after a Discard. The Dealer has to Hit on 4 or lower. The Dealer has to Stand on 5 or higher after a Discard. If the Dealer's first card is six or less, additional card(s) are dealt until the Dealer's hand: (1) totals seven; or (2) totals higher than seven. If the Dealer's hand totals higher than seven, the Dealer slides one card forward (or discards in any other manner) that does not benefit her hand, according to the Discard rules being used. If, after the Discard, the Dealer's hand has not yet reached a total of 5, 6, or 7, the Dealer must Hit again until her hand is 5, 6, or 7. If the Dealer's hand totals greater than seven after the Discard, then the Dealer's hand is Bust. In a preferred embodiment, when the Dealer has a Bust, all players win who have not themselves received a Bust hand. If the Dealer's first card is 8, 9, or 10, the Dealer must Discard such first card and Hit until the Dealer hand reaches a value greater than or equal to five. If the Dealer's second card is also an 8, 9, or 10, or if the Dealer's post-Discard hand has a value greater than seven, the Dealer has a Dealt Bust hand. Preferably, the Dealer always has to complete her hand, unless all players have already Busted. When a player has a Bust, but places a Hazard Bet, discussed below, the Dealer has to complete her hand despite all players receiving a Bust. In an alternative, the Dealer must complete her hand even when a Hazard Bet is not used.

In the example of the QUICK SEVEN game, if the first card in a player or Dealer's hand is a seven, that player or Dealer has a QUICK SEVEN. In a preferred embodiment, such a player immediately receives a Bonus percentage of their original bet. The Bonus percentage may vary between different embodiments, and may vary among different casinos, online establishments, etc. Preferably, the player would also have the option to Press or Hold the Bonus. A "Press" allows the player with a Quick to make a subsequent bet. Preferably, the player places her Bonus on the line of the wager circle or adds the Bonus chips to her wager stack. If the player's Quick beats the Dealer (e.g., the Dealer fails to get a Quick, Natural, or Soft seven), the player receives winnings equal to her combined bet. If the Dealer gets a seven, then the player with a Press loses her original bet and the Bonus. Of course, the player who receives a Bonus can decline the option of a Press. A Bonus can alternatively be a wager on a subsequent hand.

A Hazard Bet is a wager that may be used in various games and is believed to be unique, either standing alone or used in combination with a Quick game. An exemplary description is now provided. After a player has received a Bust hand that meets criteria specified in the local house rules, the Dealer asks that player if they would like to place a Hazard Bet. Such gives the player the option to bet, for example, the table minimum or any other additional wager amount up to and including the amount of the player's original wager. Any other appropriate wager rules may be alternately used. The player's Hazard Bet is preferably placed on the line of the wager circle. The player making the Hazard Bet does not receive any additional cards and simply retains her Bust hand. A Hazard Bet is a bet that the Dealer will subsequently receive a Bust. If the Dealer does then receive a Bust for the hand, the player's winnings are equal to her combined bet. If the Dealer does not Bust, the player loses her total combined bet. As a result of using a Hazard Bet, each player is afforded at least one opportunity to maintain a wager in every possible hand.

FIG. 1 is a flow chart describing a dealing procedure 10 for a player, in an exemplary embodiment of a game according to the invention. The game has a predetermined target number, achievable by one card. Although the illustrated method 10 is described for a single player, it may be easily adapted to allow for any number of simultaneous players. For example, a typical casino table has table space for up to six or seven players, whereas an online game could theoretically have no upper limit for the number of simultaneous players although such an upper limit could depend on the number of standard decks of cards being used for the game.

In step 11, the Dealer deals a first face-up card to each player. (In a preferred embodiment, the Dealer is given one card face-down at this time; an exemplary procedure for playing/dealing a Dealer's hand is described herein below.) The player's card is then evaluated in step 12, where it is determined whether the first card matches the target number. If so, the player's hand is a Quick, here shown as being the end of the player's hand at step 13. If the player's first card was not equal to the target number, then procedure 10 performs step 14, where the Dealer deals one face-up card at a time to the player's hand until the hand is greater than or equal to the target number. If the player's hand now equals the target number, the hand is designated as being either a Natural or a Soft and the player's hand is done, as indicated by step 25. If the player's hand is now greater than the target number, the player is required to Discard one card only, in step 17. The discarded card is preferably slid forward by the player from her hand onto a specially designated Discard area. This Discard action by the player is only appropriate if the player's hand can be made less than or equal to the target number after such Discard. If the hand cannot avoid a Bust, as shown in step 18, a playing of the hand is over at step 23. (However, as described above, if the house rules include the use of Hazard Bet, the Bust hand may still receive winnings.) After the player's Discard, if her hand totals less than the target number, she may choose to receive a Hit at step 20. If the player does not Hit, the playing of her hand is over at step 25. After each Hit requested by the player, it is determined at step 22 whether the hand now equals the target number; if not, it is determined at step 24 whether the hand is Bust. In the case where the post-Hit hand is Bust, the playing of the hand is over at step 23. In the case where the post-Hit hand equals the target number, the hand is over at step 25. If the post-Hit hand is still less than the target number, the player has the option, at step 20, of receiving another Hit.

Figure 2A:
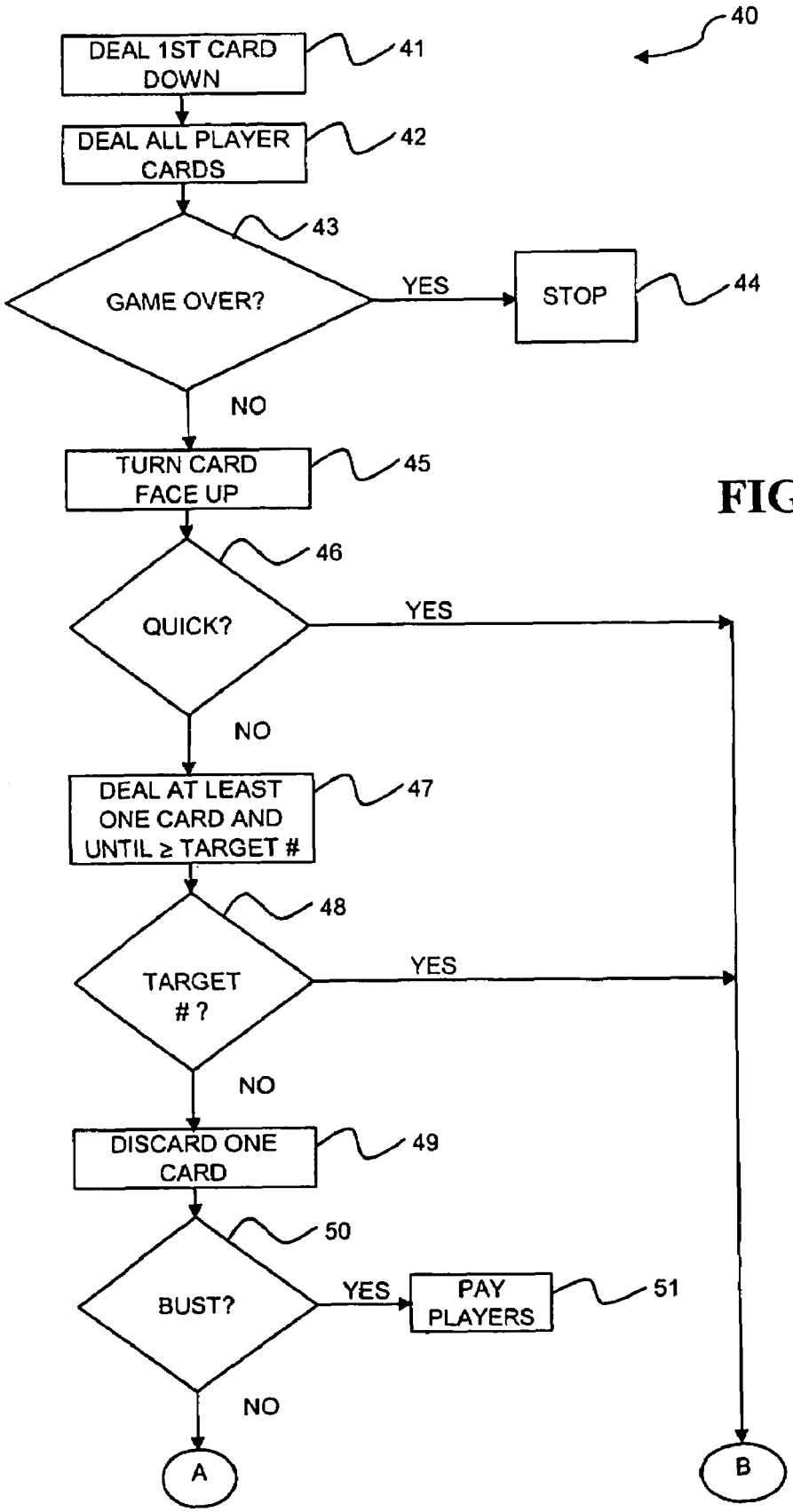
FIGS. 2A-2B show a flowchart for a dealing procedure used for dealing a hand of a Dealer, according to an exemplary embodiment of the invention.
Figure 2B:
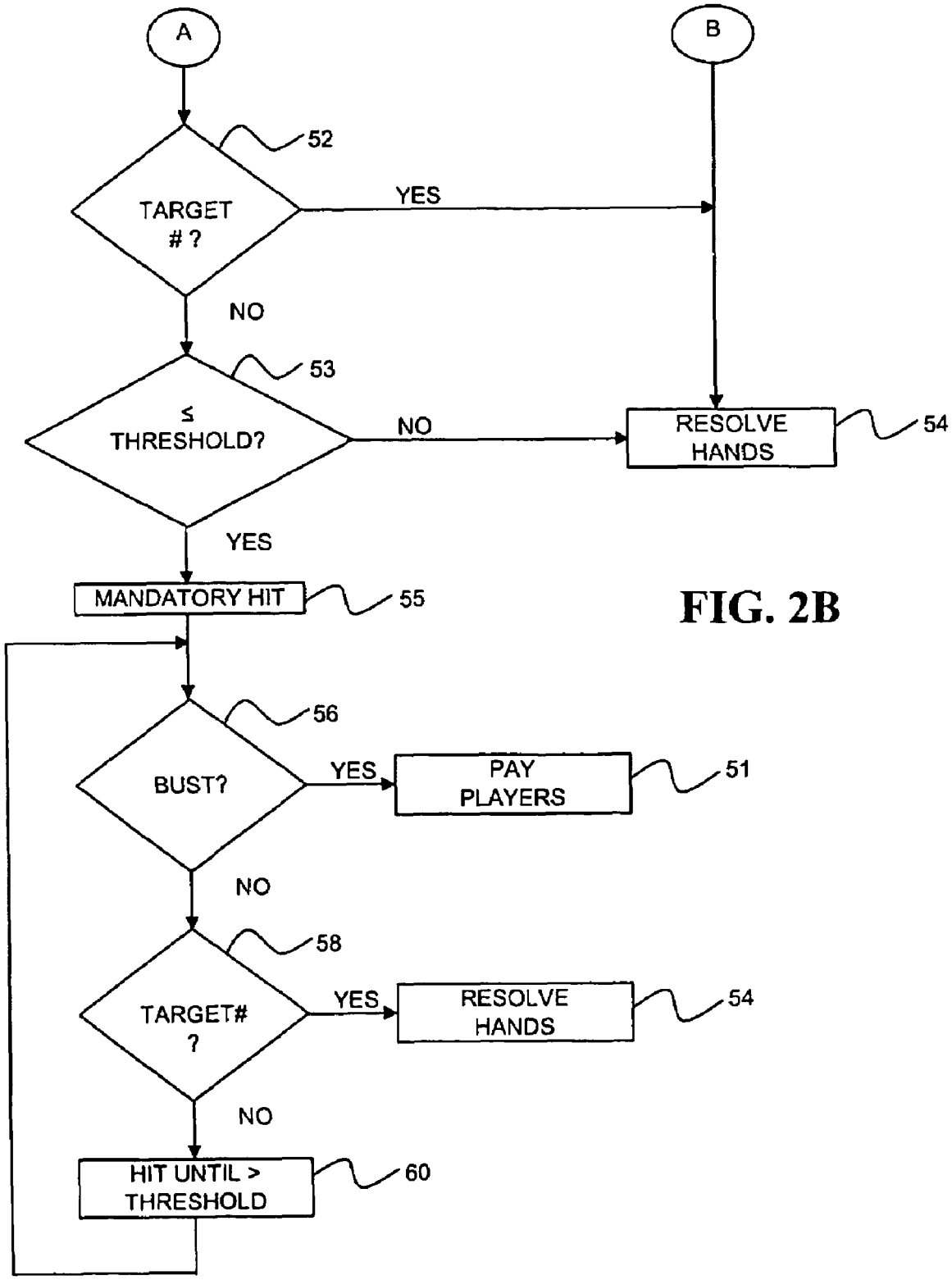

FIG. 2 is a flow chart describing a dealing procedure 40 for the Dealer, in an exemplary embodiment of a game that may include the player dealing procedure 10 described in FIG. 1. The Dealer receives her first card face down in step 41, which may be performed, for example, after all players have received their first card in step 11. After step 41, all steps of method 10 are preferably performed in step 42 before proceeding with the remainder of method 40, so that all player hands are ended before continuing with the Dealer hand. In step 43, it is determined whether all player hand(s) are already Bust. If so, and if a Bust hand has elected a Hazard Bet, the Dealer continues to deal her hand; if all player hands are Bust and if no player has elected a Hazard Bet, the hand is over at step 44, where the Dealer wins all wagers. If not all player hands are Bust, the Dealer continues to step 45, where she turns her first card face-up. In step 46, the Dealer determines whether her first card matches the target number. If so, the hand is a Quick, and the dealing is over at step 54, where all player hands are resolved against the Dealer hand. If the Dealer's first card was not a Quick, then the Dealer at step 47 deals her hand one face-up card at a time until the hand totals the target number or greater. At step 48, if the Dealer hand is now has a total that matches the target number, the dealing is over and a resolution of winner(s) and loser(s) is made at step 54. If the Dealer hand has a total that is greater than the target number, the Dealer discards at step 49 one card only. If the Dealer cannot Discard without having a Bust hand, the game is over and the Dealer pays all active players including any who made a Hazard Bet, at step 51. If the Dealer's post-Discard hand now equals the target number, that hand is denominated a Natural or a Soft, the dealing for the game is over, and the player hand(s) is/are compared at step 54 with the Dealer hand to determine whether a given player hand is a winner, loser, or Push. Step 53 is based on house rules that mandate when the Dealer must hit and when the Dealer must Stand. A predetermined threshold number is used, so that when the Dealer's hand is less than or equal to the threshold, the Dealer must Hit, at step 55. If, at step 53, the Dealer hand is greater than the threshold number, then the Dealer must Stand, the dealing of the game is over, and the player hand(s) are resolved at step 54 by comparing with the Dealer hand. When the Dealer has received the required Hit at step 55, her hand is then evaluated for a Bust, at step 56, or for a match with the target number, at step 58. For a Bust, the Dealer pays the players in step 51. For a match, in this case a Soft, the player hand(s) are resolved against the Dealer hand in step 54. At this point in Dealer dealing procedure 40, in a preferred embodiment, the Dealer is now required to Hit, at step 60, until her hand is greater than or equal to the threshold number, whereupon the Dealer must Stand if her hand is not a Bust. In an alternate embodiment, a step 60' (not shown) gives the Dealer the option to continue to receive a Hit after her hand is greater than the threshold number, when at least one player has a higher value hand. In yet another embodiment, a step 60" (not shown) requires the Dealer, post-Discard, to Hit until her hand is greater than or equal to the target number, with the result then being either a Bust or a Soft. Other variations for house rules may alternatively be used for dictating the dealing of the Dealer hand. The Dealer is preferably required to complete her hand unless all player hand(s) are Bust and no player has made a Hazard Bet.

In a preferred live casino gaming environment, all players at the table place their bets as their wager on one hand of one game. The Dealer then deals each wagering player one face-up card, from the Dealer's left to right. The Dealer then deals herself one face-down card. The Dealer then complete's the hand of the first player on her left by dealing to that hand according to player dealing rules. The Dealer proceeds to complete the hand(s) of all players, one at a time, from the Dealer's left to right. If all players have a Bust, then the game is over, unless at least one player having a Bust has made a Hazard Bet. The Dealer then completes her own hand and then determines winners, losers, and Push(es) among the player(s). The Dealer then collects all losing wagers, returns all Pushed wagers, and pays all winning wagers. The Pushed wagers may be subject to house rules, such as a requirement that such Push wager be applied to a next game. This process is repeated for each round/game.

Figure 3A:
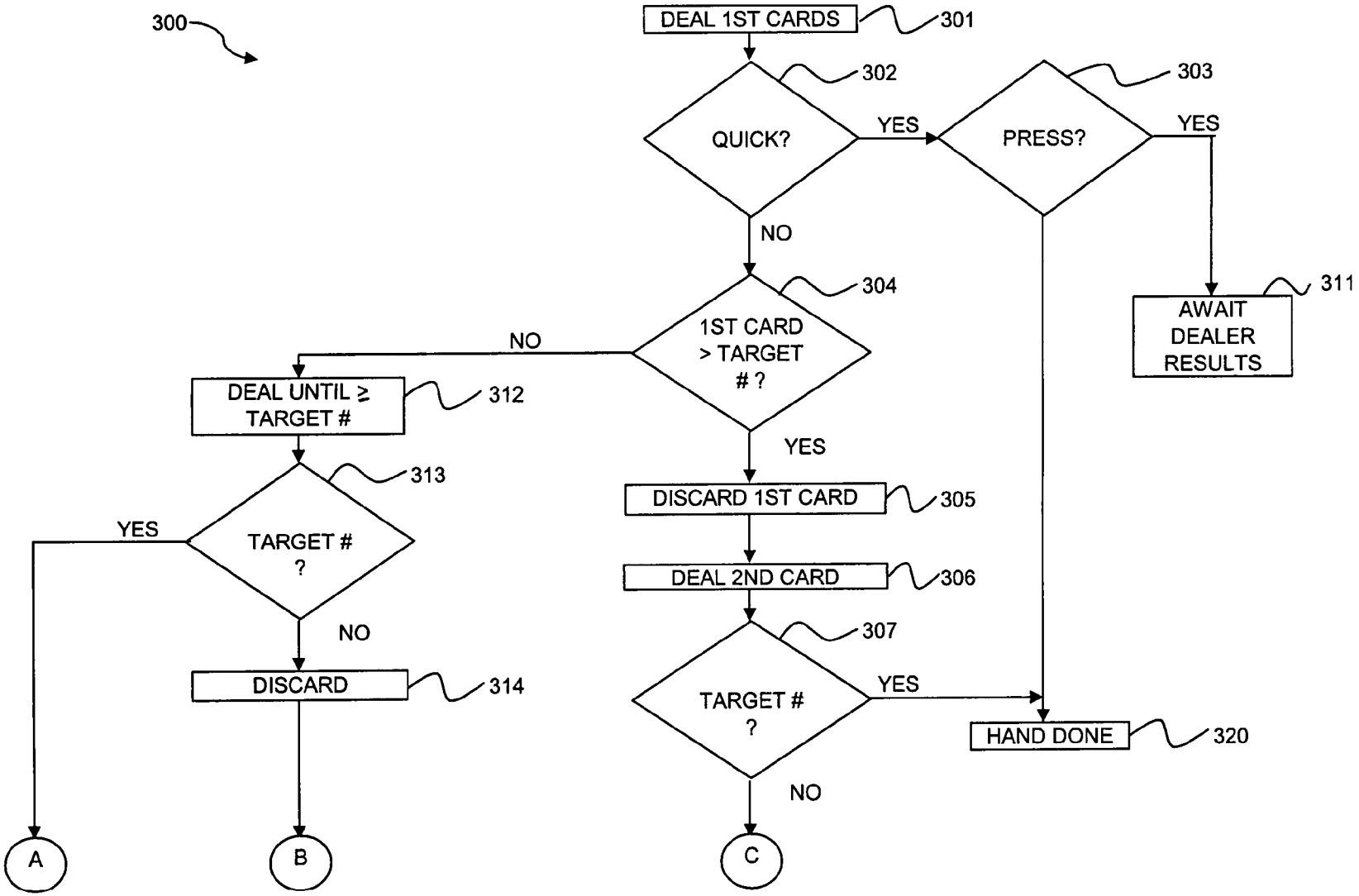
FIGS. 3A-3B show a flow chart for a dealing procedure used for dealing a hand of a player, according to an exemplary embodiment of the invention.
Figure 3B:
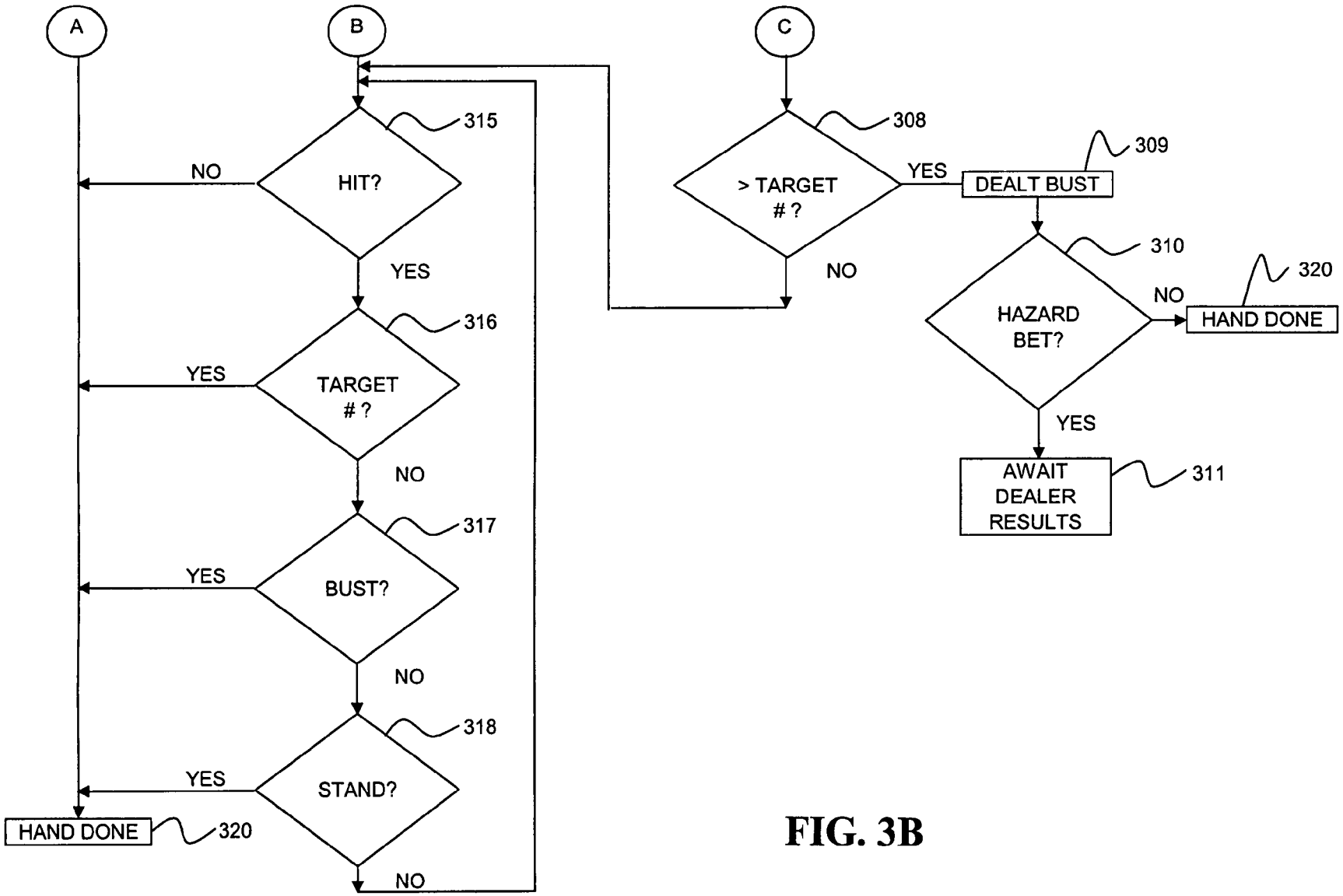

FIGS. 3A-3B show a flow chart describing a dealing procedure 300 for a player, in another exemplary embodiment of a game according to the invention. As for method 10 of FIG. 1, the game has a predetermined target number, achievable by one card. Although the illustrated method 300 is described for a single player, it may be easily adapted to allow for any number of simultaneous players. In step 301, the Dealer deals a first face-up card to each player. The player's card is then evaluated in step 302, where it is determined whether the player's hand is a Quick. If so, the player is given the option at step 303 to Press or Hold. If the player decides to Press, the player's wager determination must await the results of the Dealer hand at step 311. If the player decides to Hold, the player's hand is resolved at step 320 according to house rules that may include the results of the Dealer hand. If the player did not have a Quick, then it is determined at step 304 whether the player's first card exceeded the target number. If so, then that first card is automatically discarded by the Dealer at step 305 and the Dealer gives the player a second card at step 306. Step 307 determines whether that second card matches the target number and, if so, the hand is a Natural and is resolved at step 320. If the second card is determined at step 308 to be greater than the target number, the hand is denominated as a Dealt Bust at step 309 and then step 310 gives the player the option to place a Hazard Bet. When the player chooses the Hazard Bet, her wager is then determined at step 311 according to whether the Dealer receives a Bust hand. When the player does not elect to place a Hazard Bet, her hand is over according to step 320. When the player's second card is determined at step 308 as not greater than or equal to the target number, the player's hand proceeds to the post-Discard Hit routine of steps 315-318. Returning to step 304, when the player's first card is determined to be less than the target number, the hand, at step 312, is dealt as many cards as necessary to meet or exceed the target number. If the hand now equals the target number at step 313, the hand is denominated a Soft and is resolved according to house rules at step 320; if the hand now exceeds the target number, the player chooses a card to Discard at step 314. The player then decides at step 315 whether to Hit her hand. If she elects to Stand, the hand is over and is resolved at step 320. If the player chooses a Hit, then steps 316 and 317 respectively determine whether the hand is a Soft or a Bust. If so, the hand is over and is resolved at step 320. If the hand is still less than the target number, the player may choose to Stand at step 318 or proceed to receive another Hit at step 315. The player may continue in this manner to receive additional Hits so long as she wants and so long as she meets the criteria of having a hand less than the target number.

The following is an exemplary list of hands where a player wins and the Dealer loses:

(a) Player normal hand closer to target number than Dealer's normal hand.
(b) Player normal hand to Dealer Bust.
(c) Player Soft or Natural to Dealer normal hand.
(d) Player Soft or Natural to Dealer Bust.
(e) Player Quick to Dealer normal hand.
(f) Player Quick to Dealer Bust.
(g) Player Hold Bonus to Dealer normal hand, Soft, Natural, Quick, or Bust.
(h) Player Press Bonus to Dealer normal hand, or Bust.
(i) Player Hazard Bet to Dealer Bust.

The following is an exemplary list of hands where the Dealer wins and a Player loses:

(a) Dealer normal hand closer to target number than Player normal hand.
(b) Dealer normal hand to Player Bust.
(c) Dealer Soft or Natural to Player normal hand.
(d) Dealer Soft or Natural to Player Bust.
(e) Dealer Quick to Player normal hand.
(f) Dealer Quick to Player Bust.
(g) Dealer Soft, Natural, or Quick to Player Press Bonus.
(h) Dealer normal hand, Soft, Natural, or Quick to Player Hazard Bet.

The following is an exemplary list of Push hands between the Dealer and a Player:

(a) normal hand to normal hand (same value).
(b) Soft, Natural, or Quick to Soft, Natural, or Quick.

Dealer/house winning percentage may be easily adjusted by changing the house rules for determining a winner between a player hand and the Dealer hand. For example, house rules may be implemented to eliminate certain Push hands and replace such Pushes with a Dealer win. In such a case, for the example of QUICK SEVEN, the game might implement house rules where the Dealer wins with either a Natural seven or Soft seven against a player hand of a Natural seven or Soft seven. In another example, the house rules might be modified so that a player loses all ties with the Dealer and there are no Push hands. In a further example, the house rules may be modified so that a player Hold loses to a Dealer Quick seven. Any number of variations may be implemented for adjusting the house winning percentage.

The predetermined target number has been shown by example as being seven, but any number between two and ten may be used, thereby allowing a player to have a Quick hand with one card only. Preferably, the target number is from five to ten. A game in an exemplary embodiment may include a selection of the target number or the target number may be established. When the selection of the target number is chosen as a part of a game, the choosing may be by a random process, the choosing may be periodically delegated to a player, the choosing may be directed by a player meeting predetermined criteria, etc.

Many variations of dealing procedures, house rules, win/loss determinations, wagering options, and media may be used in a given interactive environment.

A game or variation may be implemented as a computer program or other process, for example including sequential, combinatorial, and/or object code, and others. For example, routines may perform logic for dealing of new hands, dealing cards within a hand, shuffling, discarding, playing a player hand with selectable options such as bonuses and variations on wagering, profiling average, risky, and conservative players or providing for automated player hands according to risk level, providing for player selection of risk level options, playing a Dealer hand, analyzing hand results, handling a player Quick, Natural, Soft, or Bust, handling a Dealer hand in view of results of player hand(s), and others. Each new hand may include indices corresponding to current players, determination of whether a player's hand is active, determination of whether a player should receive a card, inputting a player selection for a Discard, clearing out registers for inactive players, controlling the dealing of cards, monitoring conditions related to shuffling and implementing random processes, restarting, player options related to Press, Hold, Bonus, Hazard Bet, and others, setting of flags, accounting of player wagering, integration of automated wager monitoring and/or verification such as by a use of radio frequency identification (RFID) elements within betting chips, and other applicable software, firmware, and hardware routines. Portions of corresponding programs may be partitioned as needed, such as when implementing internet or other networked gaming, for example having a client-server architecture, master-slave relation, etc. A network server may interact with a remote player via any suitable network configuration and distribution, such as those using carrier waves and/or transmission frames through network cabling. Computer systems for implementing the game are not described herein because any suitable general purpose computer having a processor and memory may be implemented, and such are well known in the art. In another example, game cartridge systems may implement a portion of a program in a removable cartridge. Such cartridges may effect substitutes for computer memory and other components. Program(s) for implementing the card game may be contained on a computer-readable medium, may be downloaded, etc.

Figure 4:
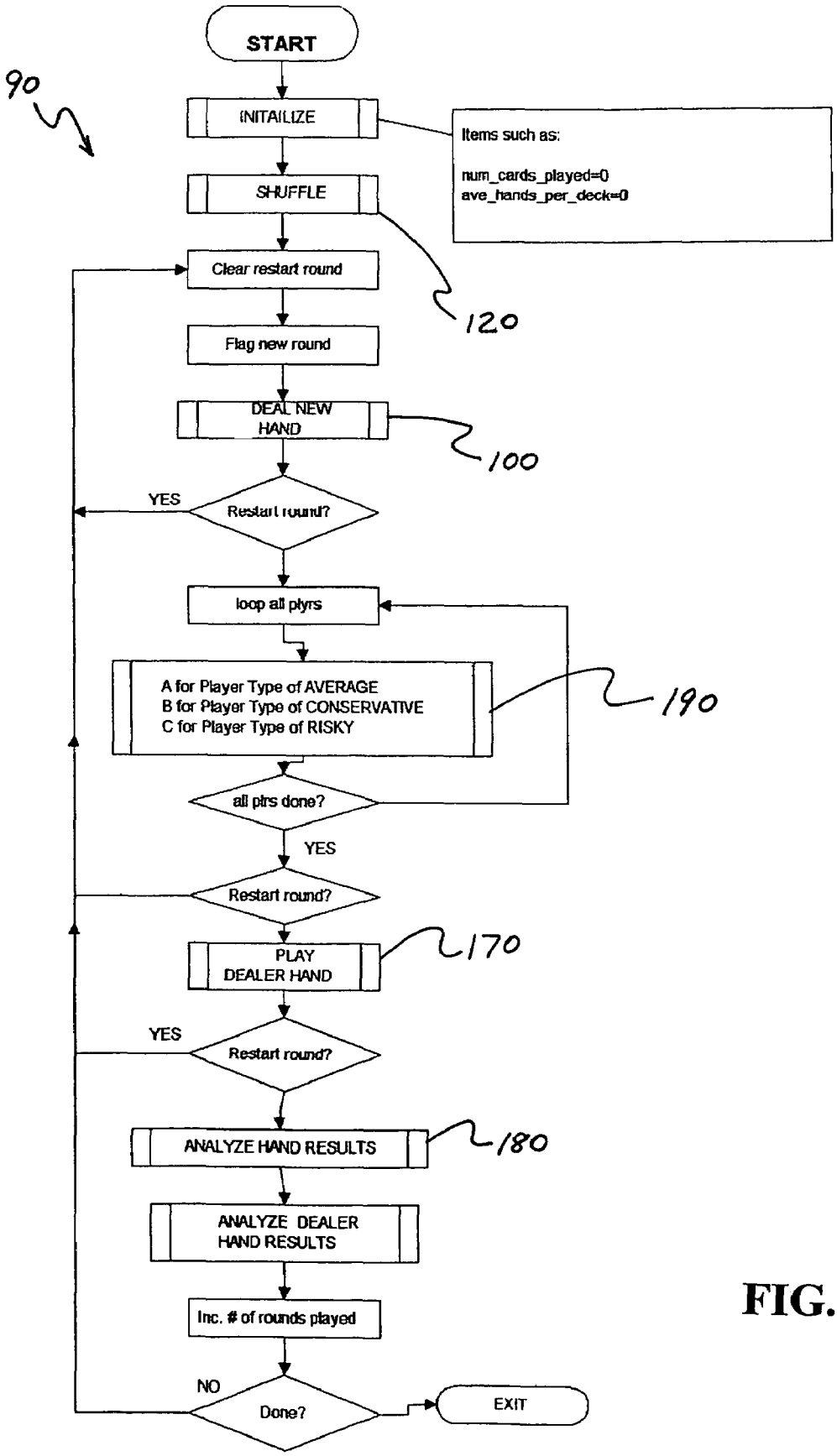
FIG. 4 is a flowchart of a method of implementing a game in a manner suitable for implementation in an automated system such as a computer, video slot, network, etc., according to an exemplary embodiment of the invention.
Figure 5:
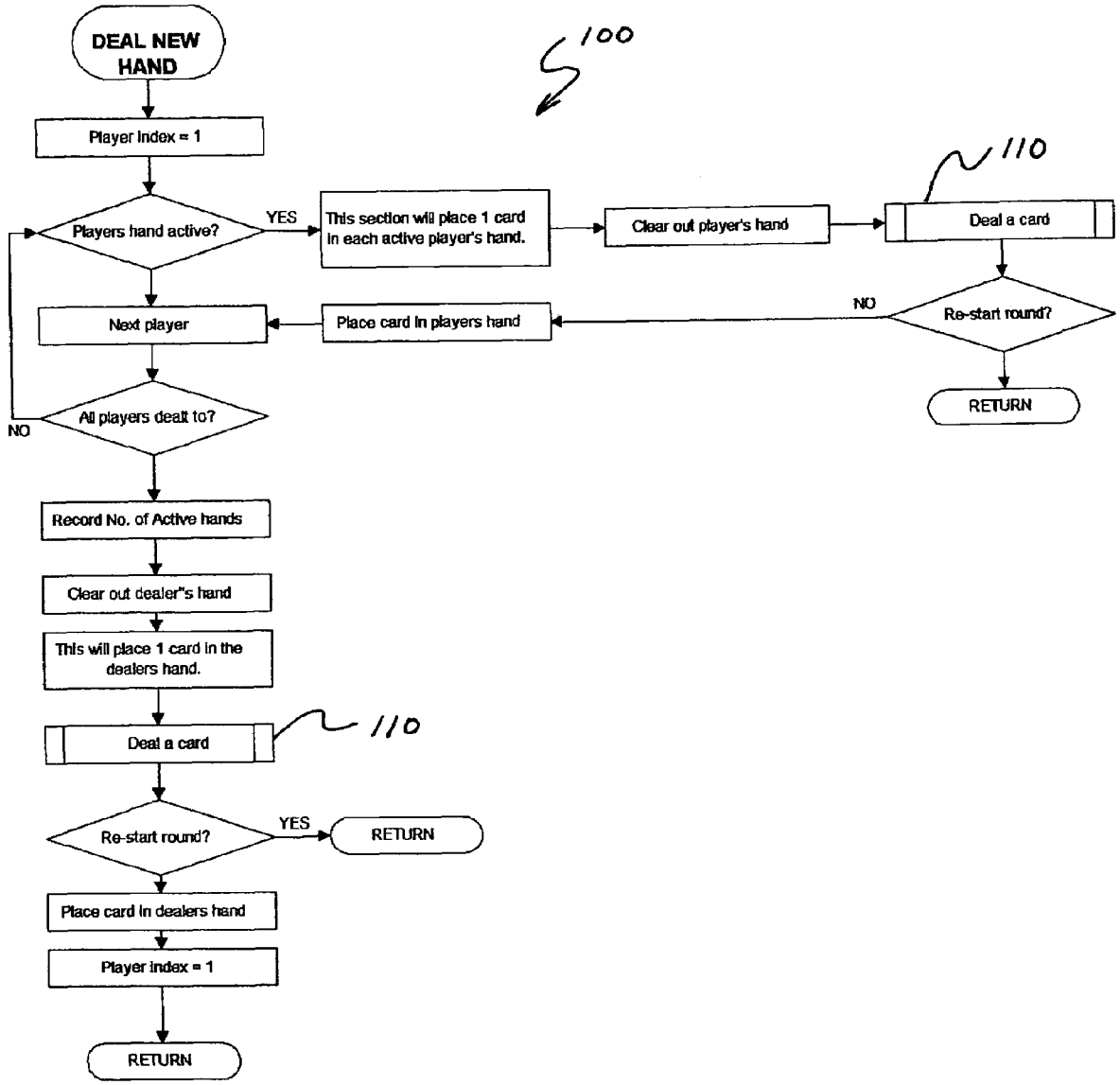
FIG. 5 is a flowchart of a method of dealing a new hand, the method being suitable for implementation in an automated system such as a computer or video slot, according to an exemplary embodiment of the invention.
Figure 6:
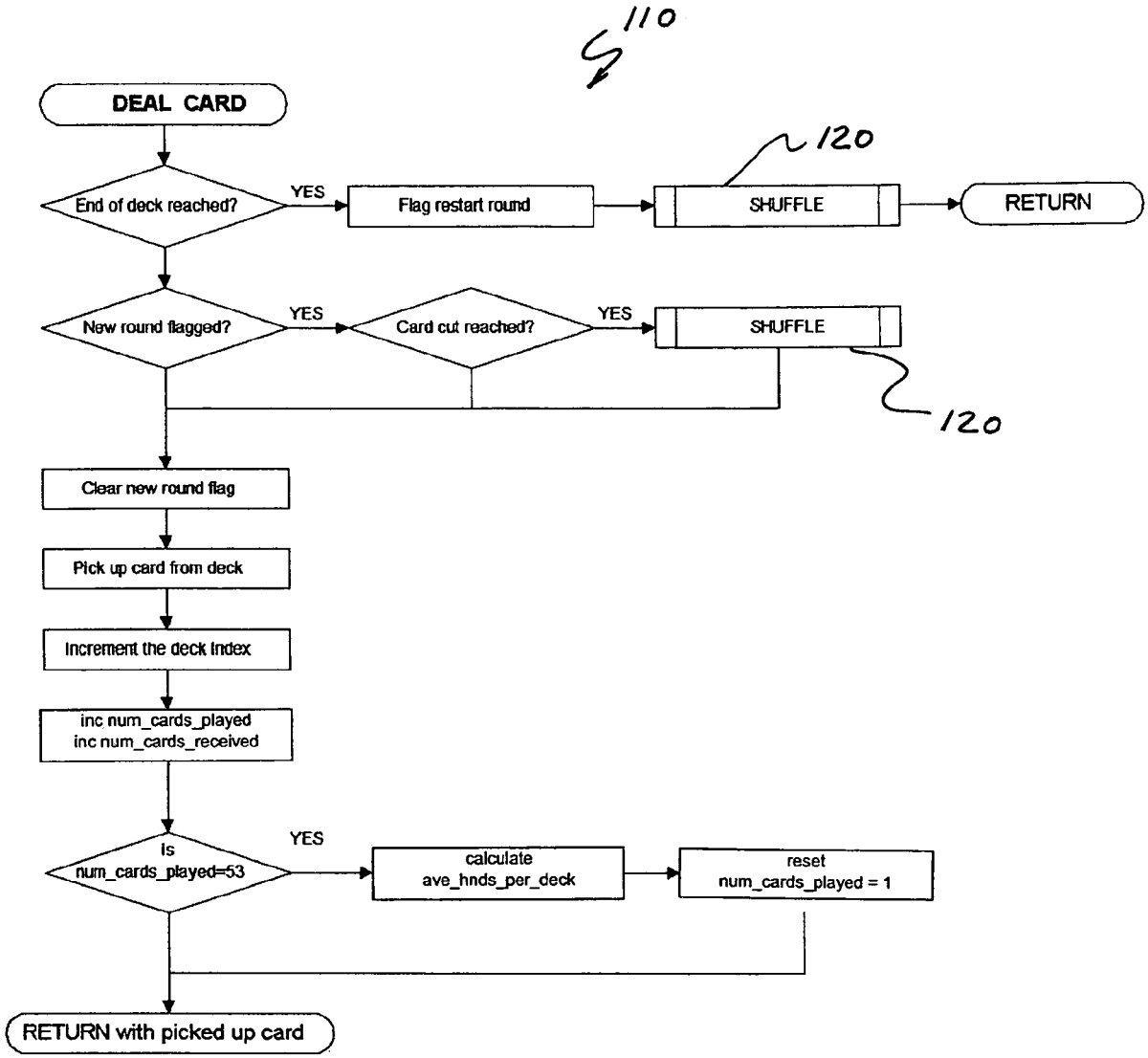
FIG. 6 is a flowchart of a method used for dealing a card, the method being suitable for implementation in an automated system such as a computer or video slot, according to an exemplary embodiment of the invention.
Figure 7:
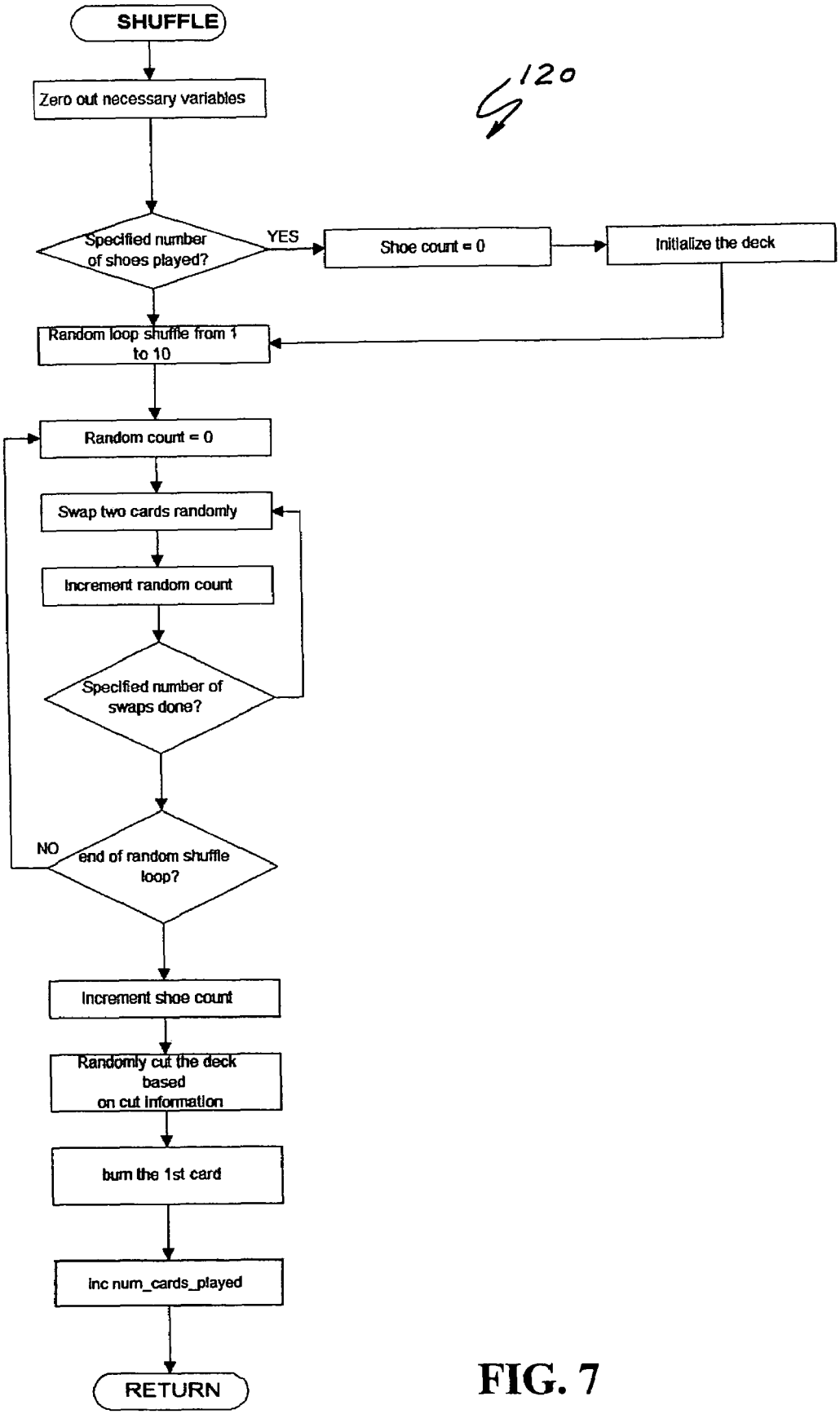
FIG. 7 is a flowchart of a method of shuffling cards, the method being suitable for implementation in an automated system such as a computer or video slot, according to an exemplary embodiment of the invention.
Figure 8:
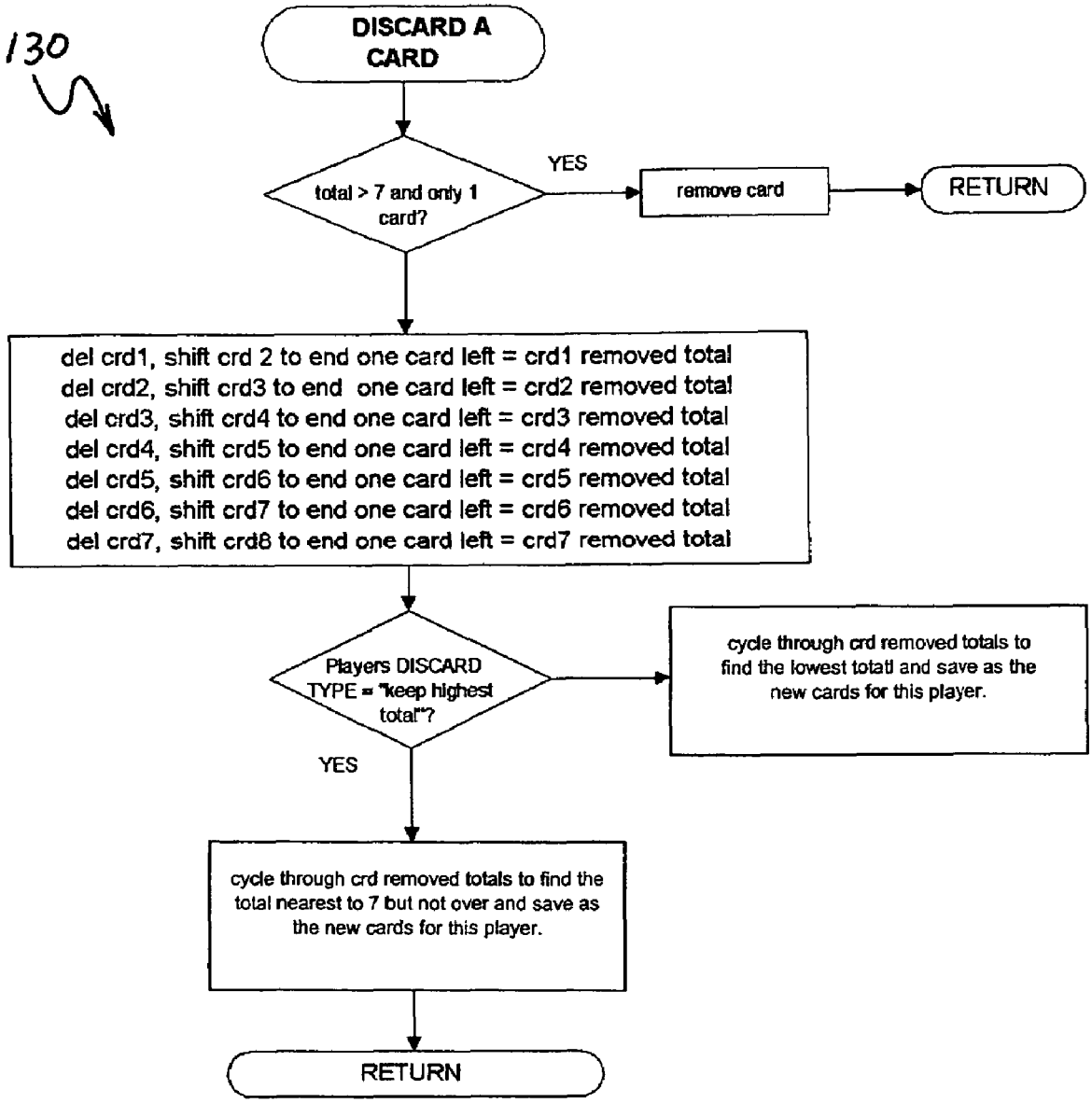
FIG. 8 is a flowchart of a method of discarding a card, the method being suitable for implementation in an automated system such as a computer or video slot, according to an exemplary embodiment of the invention.
Figure 9:
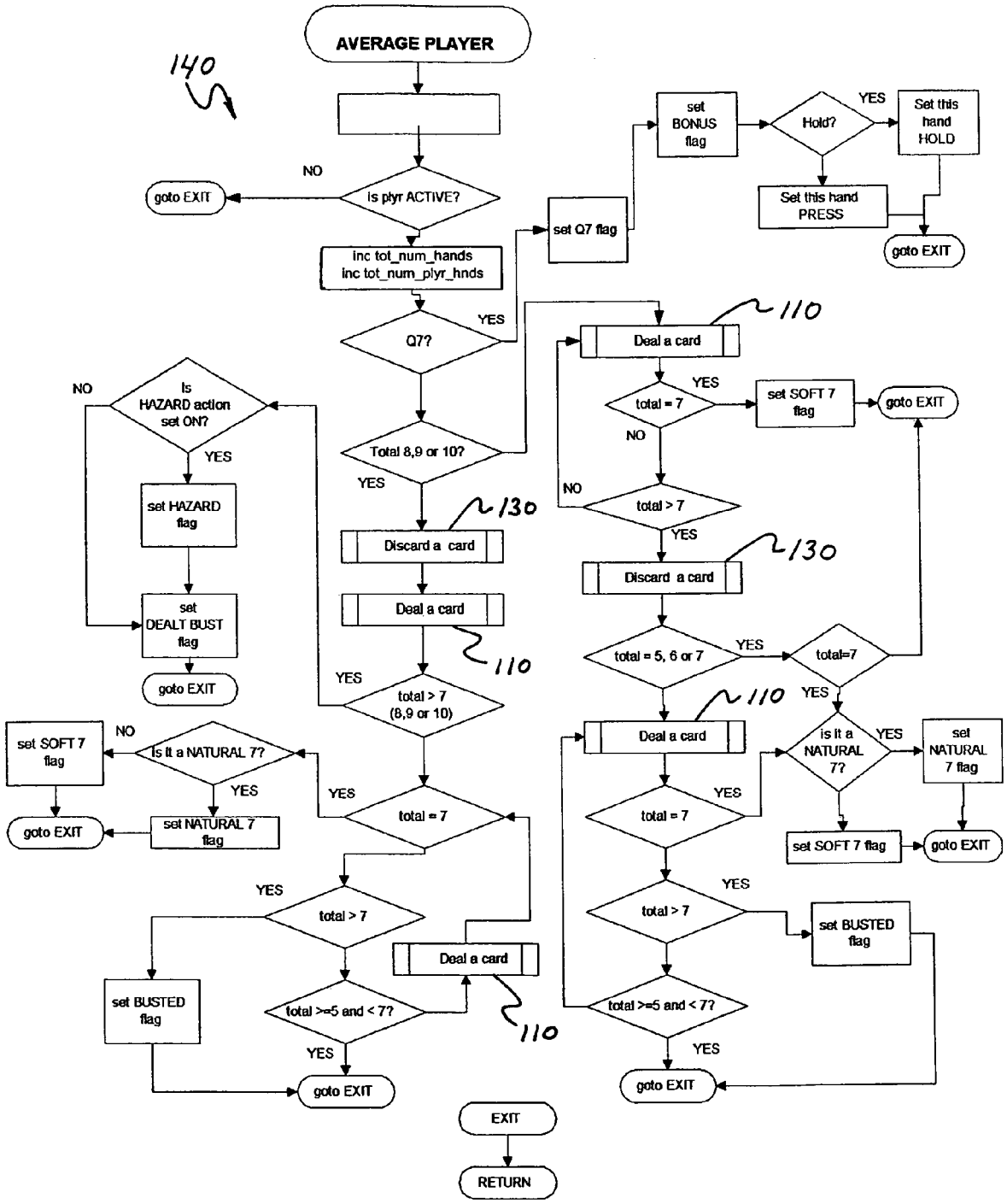
FIG. 9 is a flowchart of a method of playing a hand according to a predetermined pattern for an "average" player, the method being suitable for implementation in an automated system such as a computer or video slot, according to an exemplary embodiment of the invention.
Figure 10:
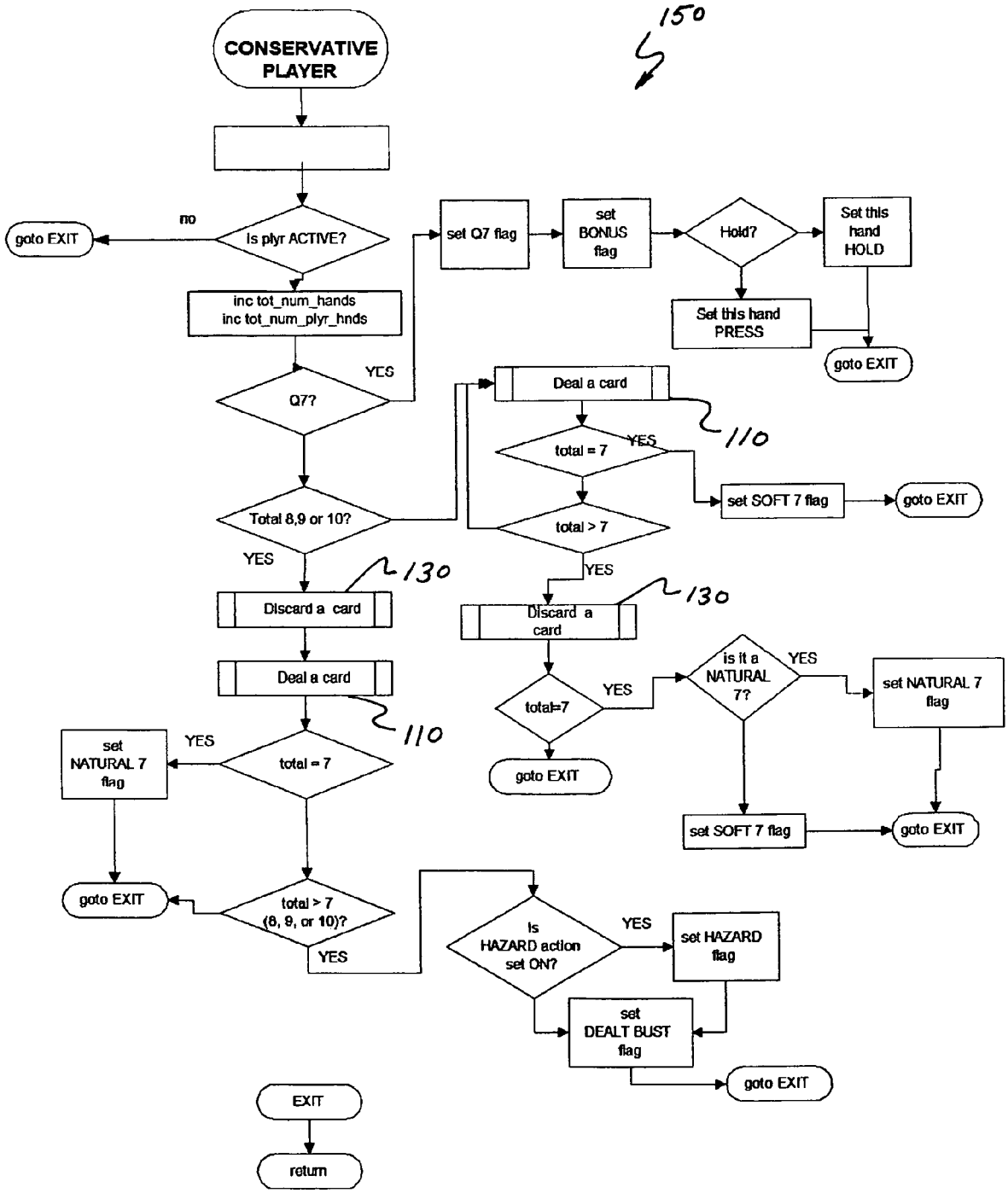
FIG. 10 is a flowchart of a method of playing a hand according to a predetermined pattern for a "conservative" player, the method being suitable for implementation in an automated system such as a computer or video slot, according to an exemplary embodiment of the invention.
Figure 11:
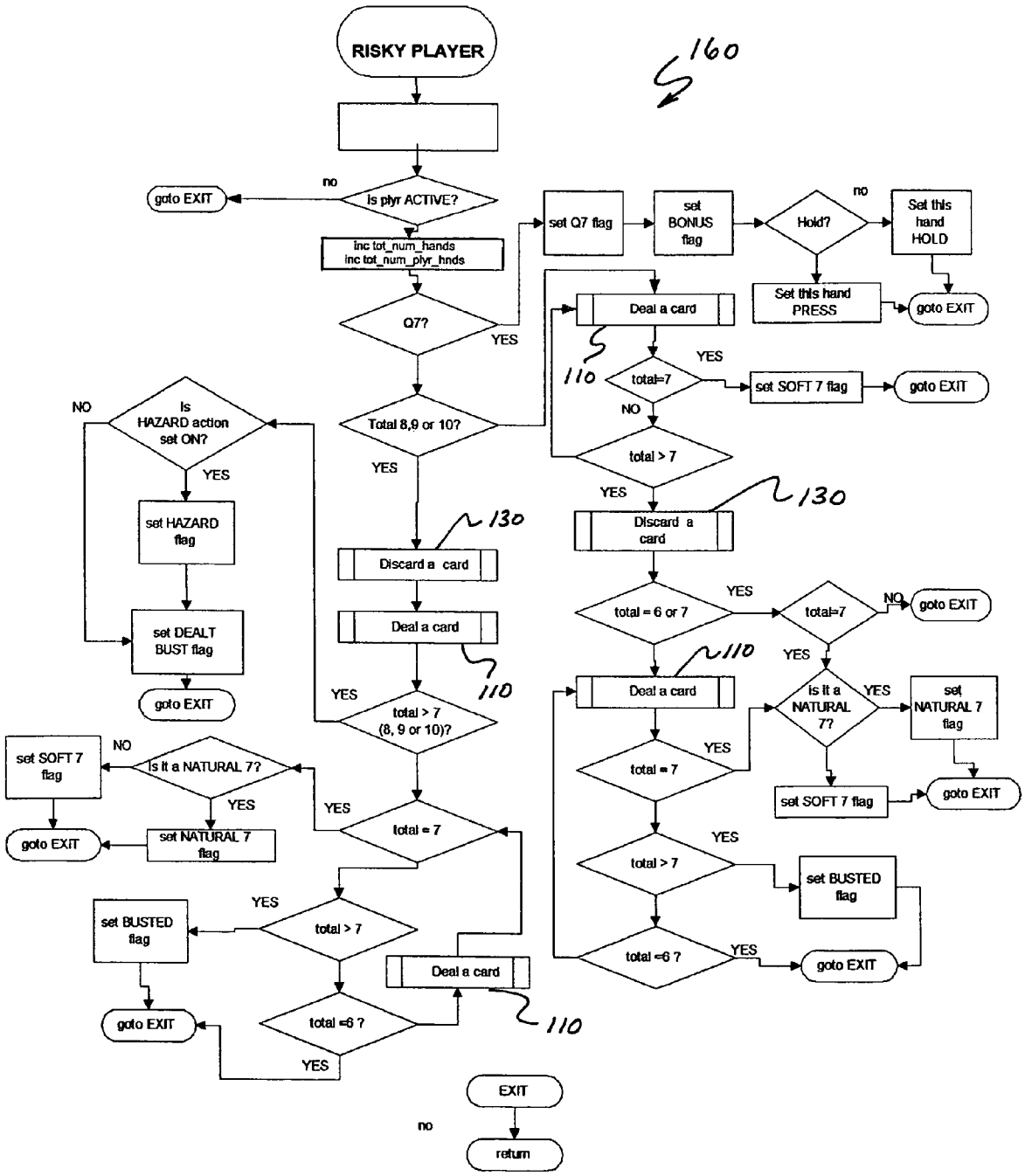
FIG. 11 is a flowchart of a method of playing a hand according to a predetermined pattern for a "risky" player, the method being suitable for implementation in an automated system such as a computer or video slot, according to an exemplary embodiment of the invention.
Figure 12:
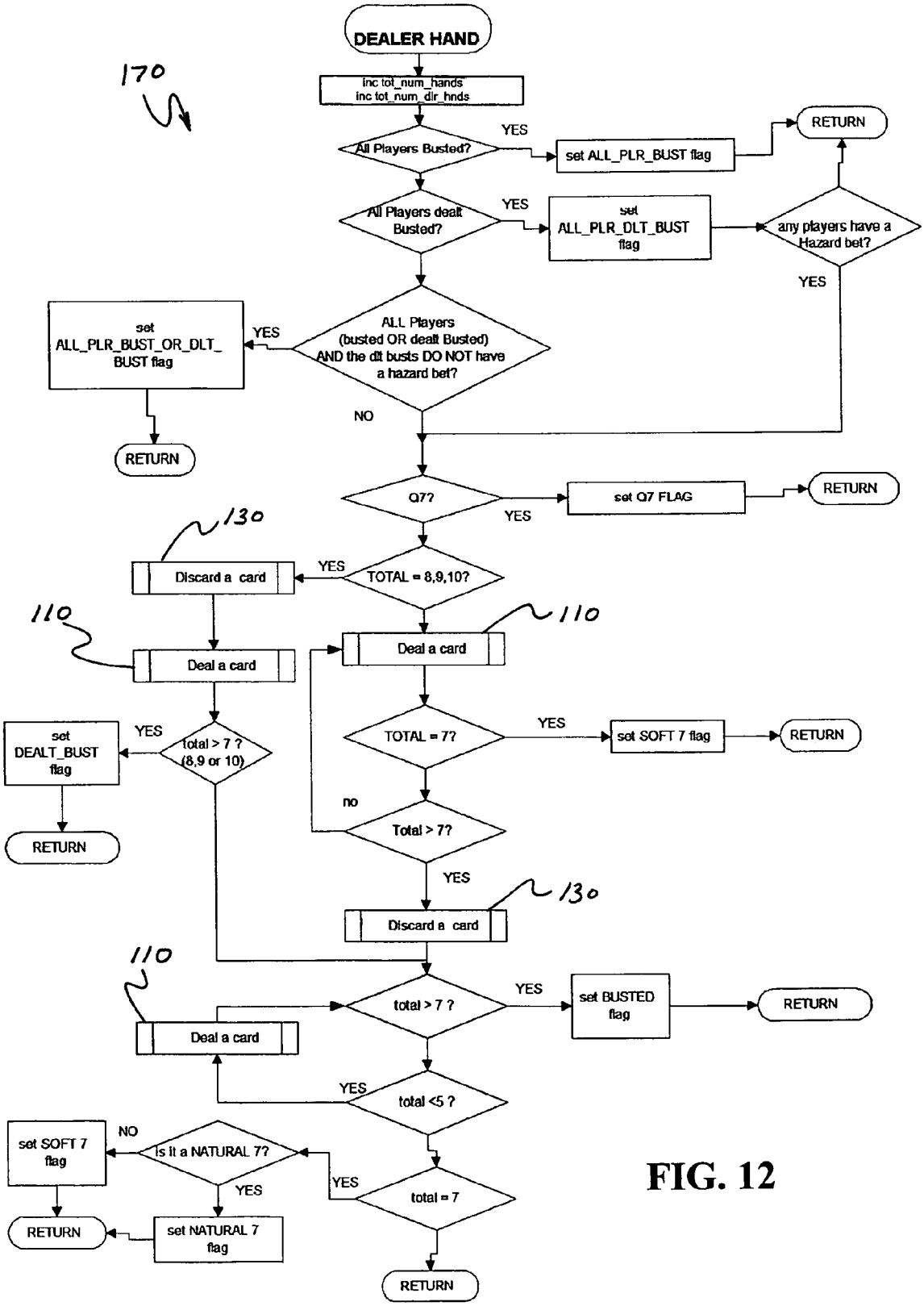
FIG. 12 is a flowchart of a method of playing a Dealer hand, the method being suitable for implementation in an automated system such as a computer or video slot, according to an exemplary embodiment of the invention.
Figure 13:
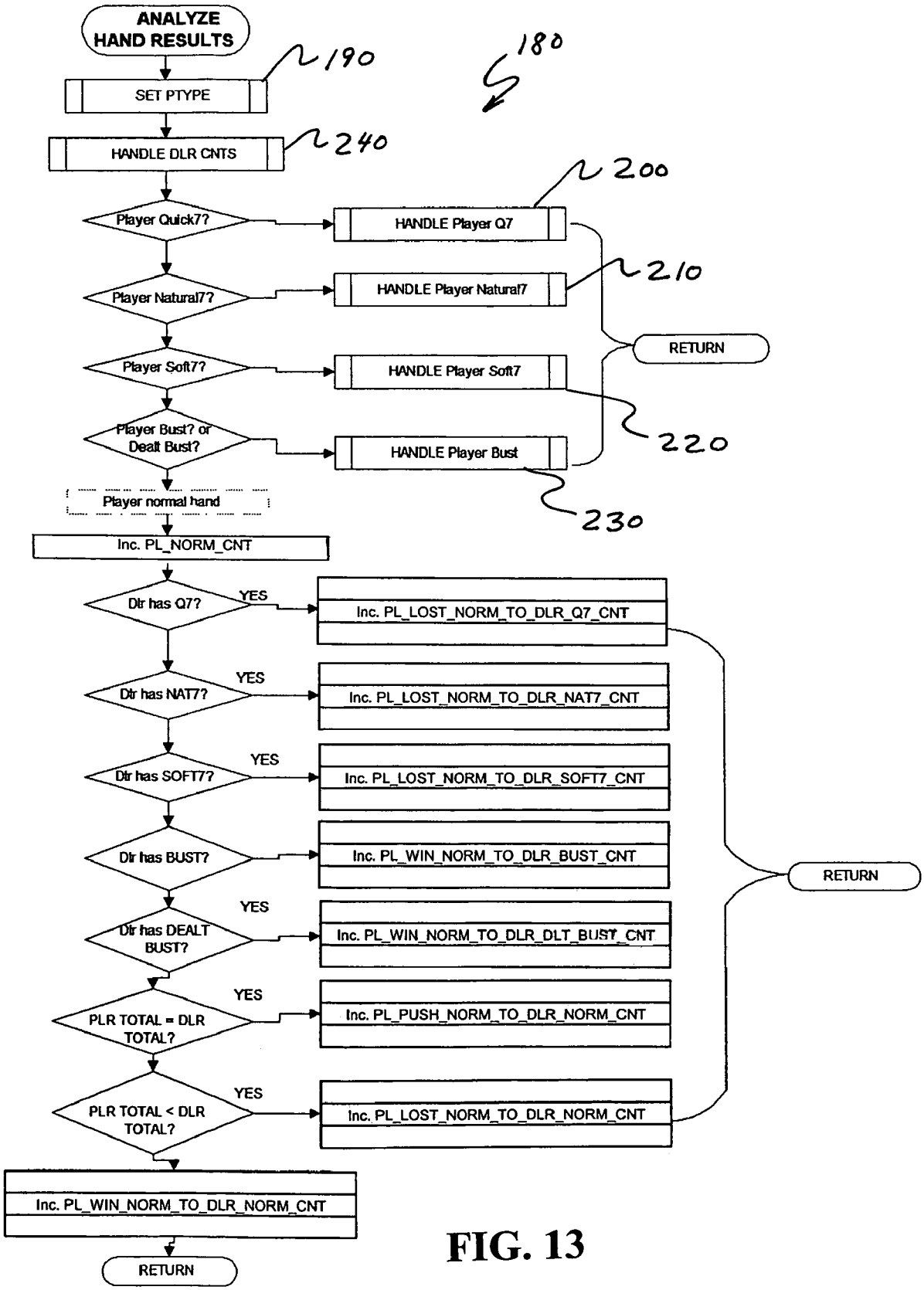
FIG. 13 is a flowchart of a method of analyzing the results for a hand, the method being suitable for implementation in an automated system such as a computer or video slot, according to an exemplary embodiment of the invention.
Figure 14:
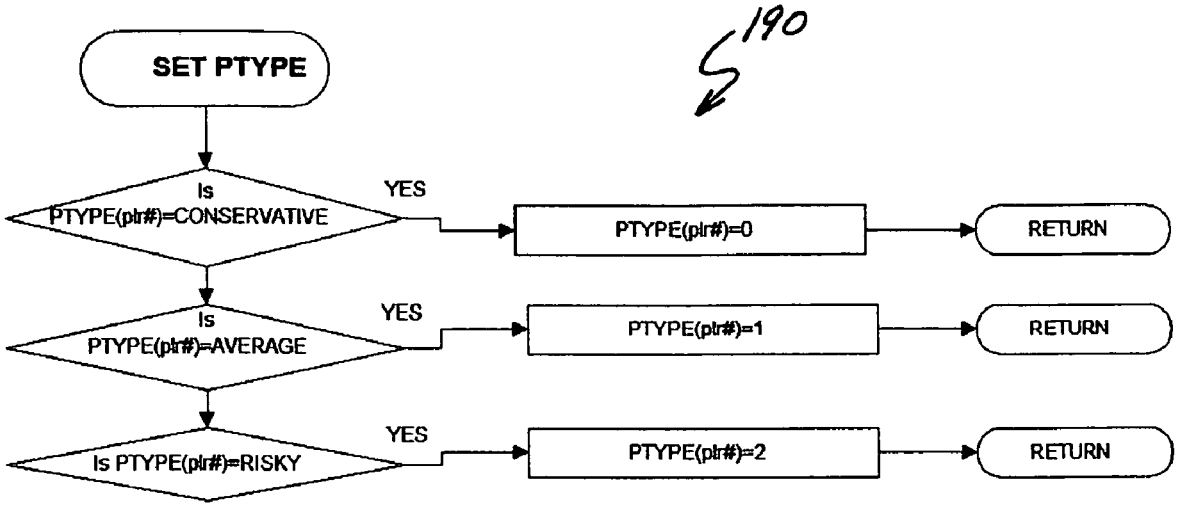
FIG. 14 is a flowchart of a method of implementing different routines for different types of players in an automated system such as a computer or video slot, according to an exemplary embodiment of the invention.
Figure 15:
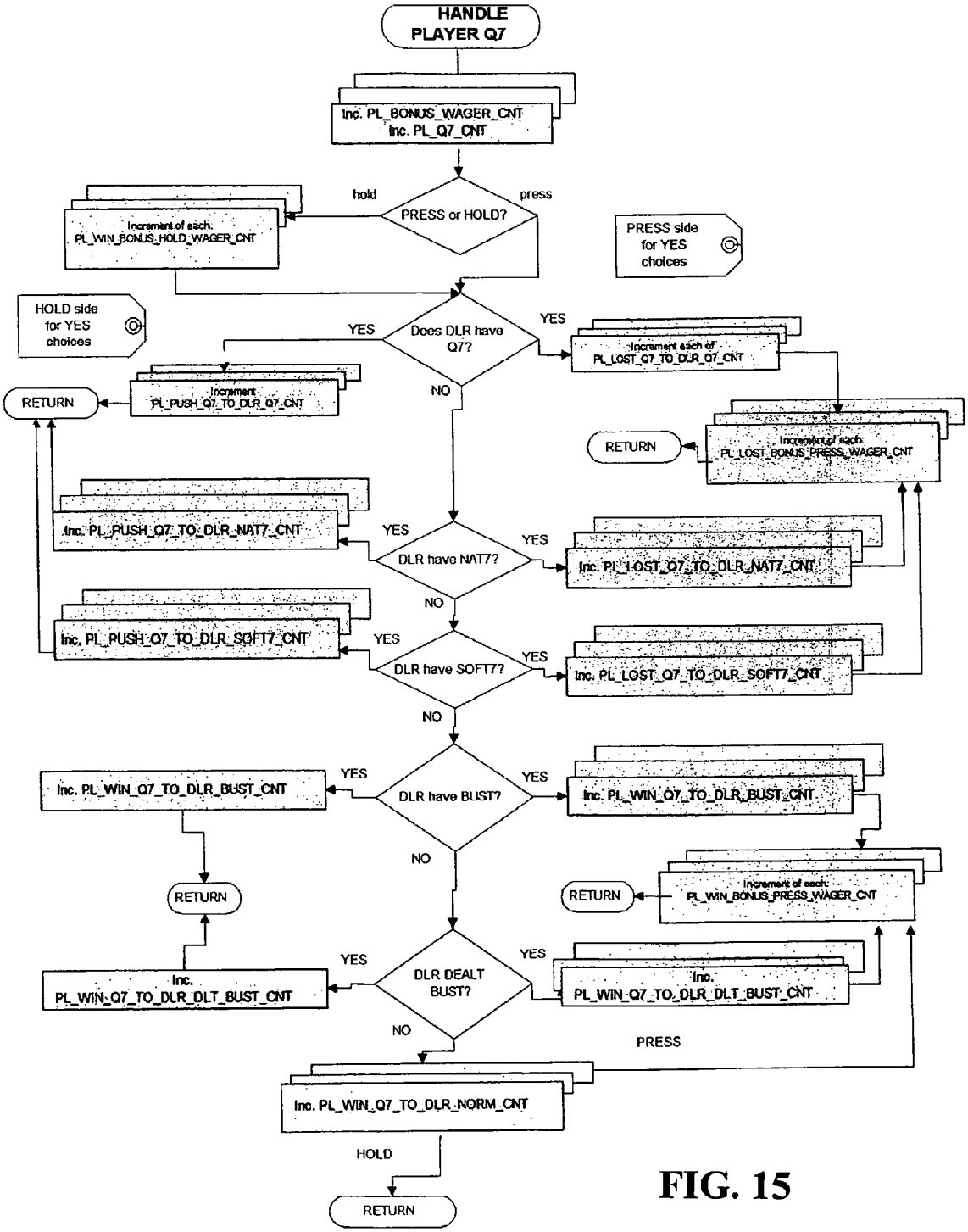
FIG. 15 is a flow chart for an exemplary computer-implemented method for an example of the game where the target number is seven, the method handling a player hand that is a Quick Seven and accounting for player Bonus wagering options including Press and Hold, and handling possible Dealer hands.
Figure 16:
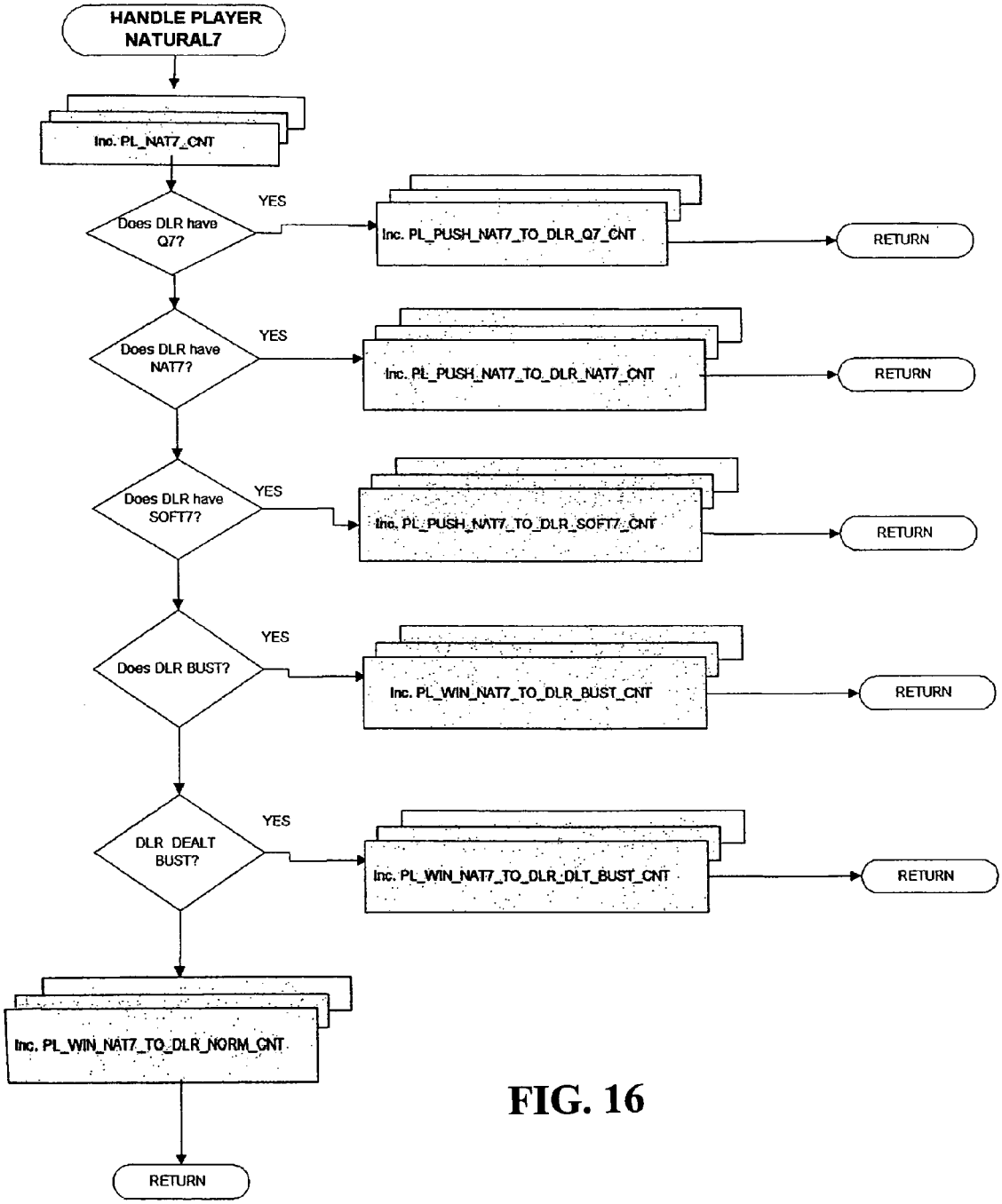
FIG. 16 is a flow chart for an exemplary computer-implemented method for an example of the game where the target number is seven, the method handling a player hand that is a Natural seven.
Figure 17:
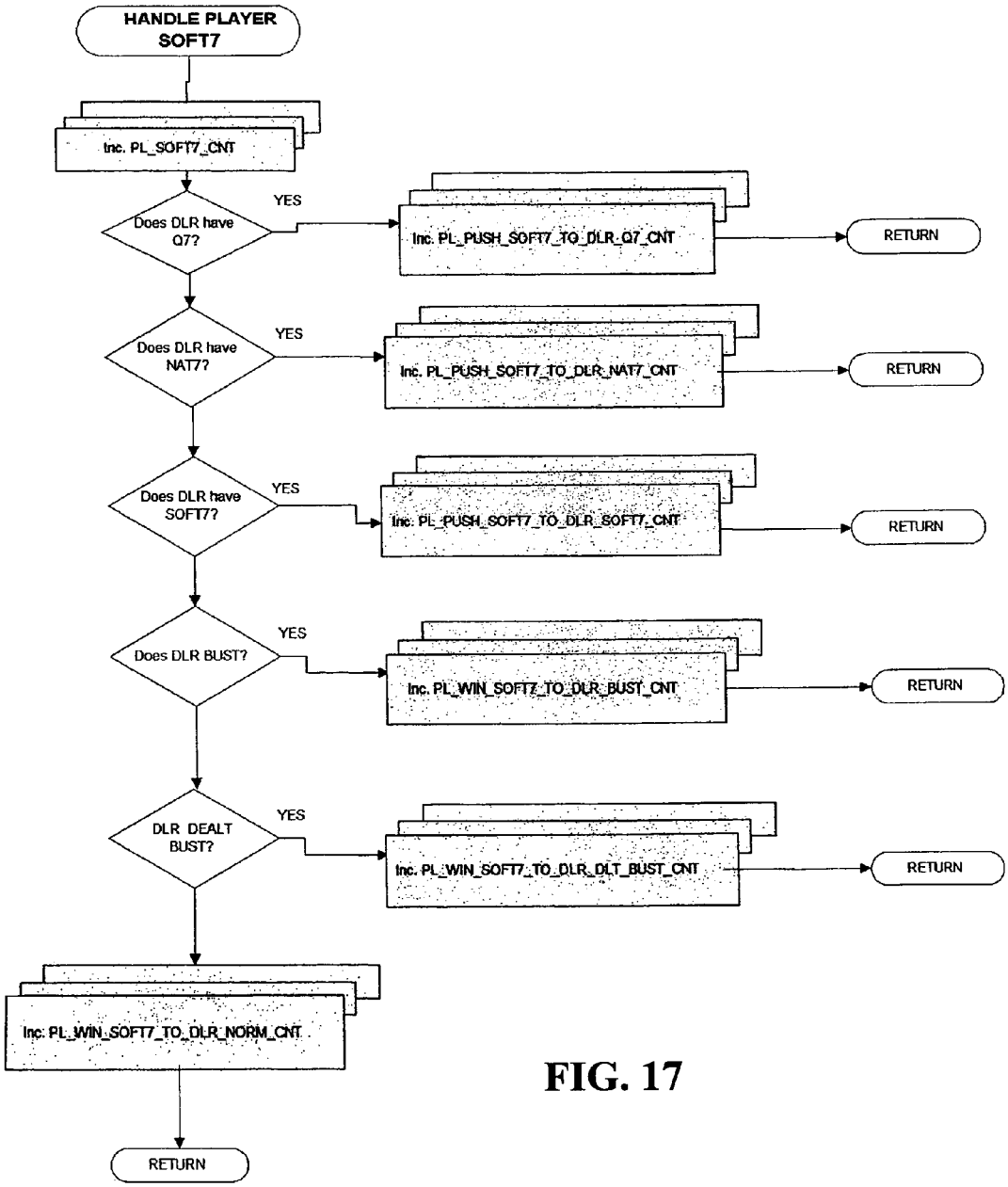
FIG. 17 is a flow chart for an exemplary computer-implemented method for an example of the game where the target number is seven, the method handling a player hand that is a Soft seven.
Figure 18:
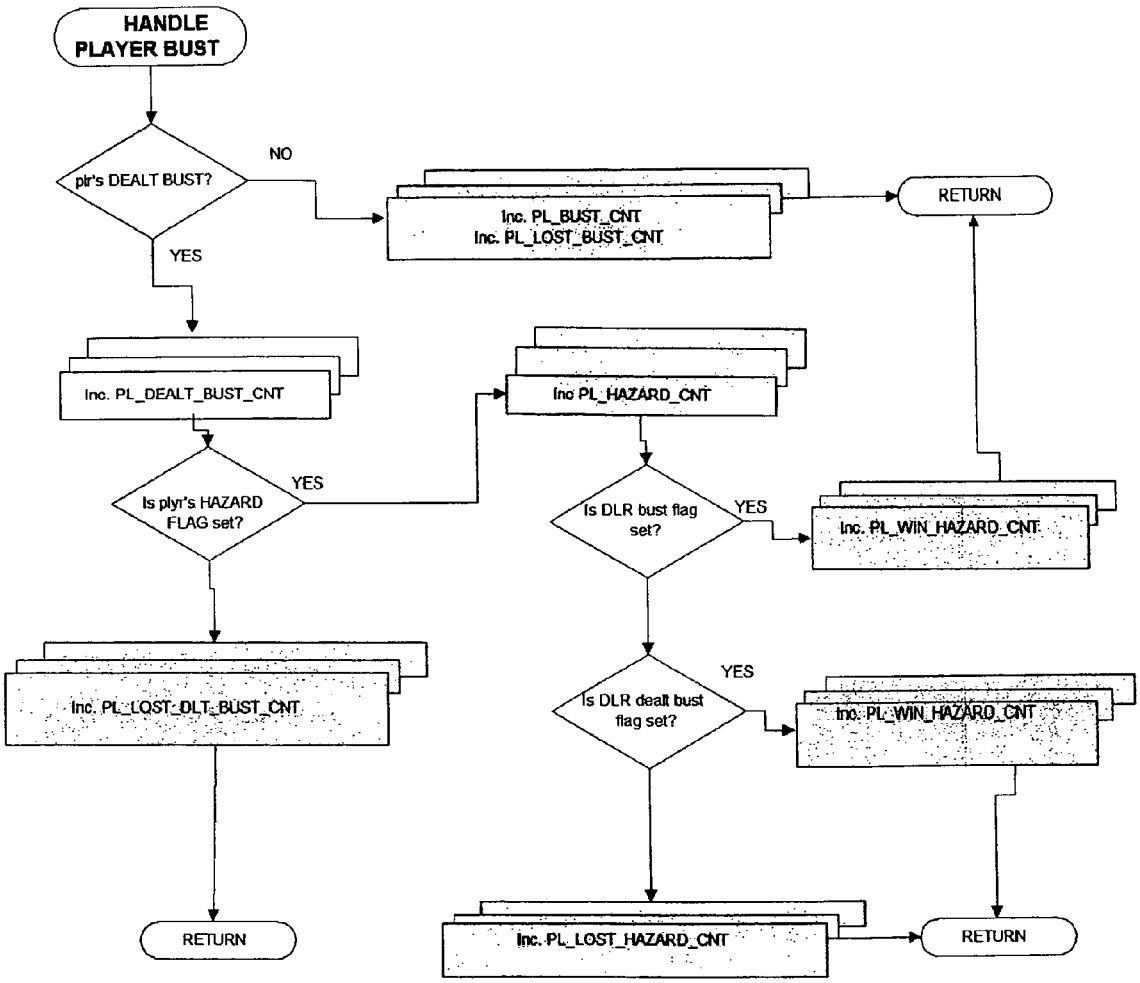
FIG. 18 is a flow chart for an exemplary computer-implemented method for an example of the game where the target number is seven, the method handling a player hand that is a Bust and including a routine for handling a Hazard Bet by the player.
Figure 19:
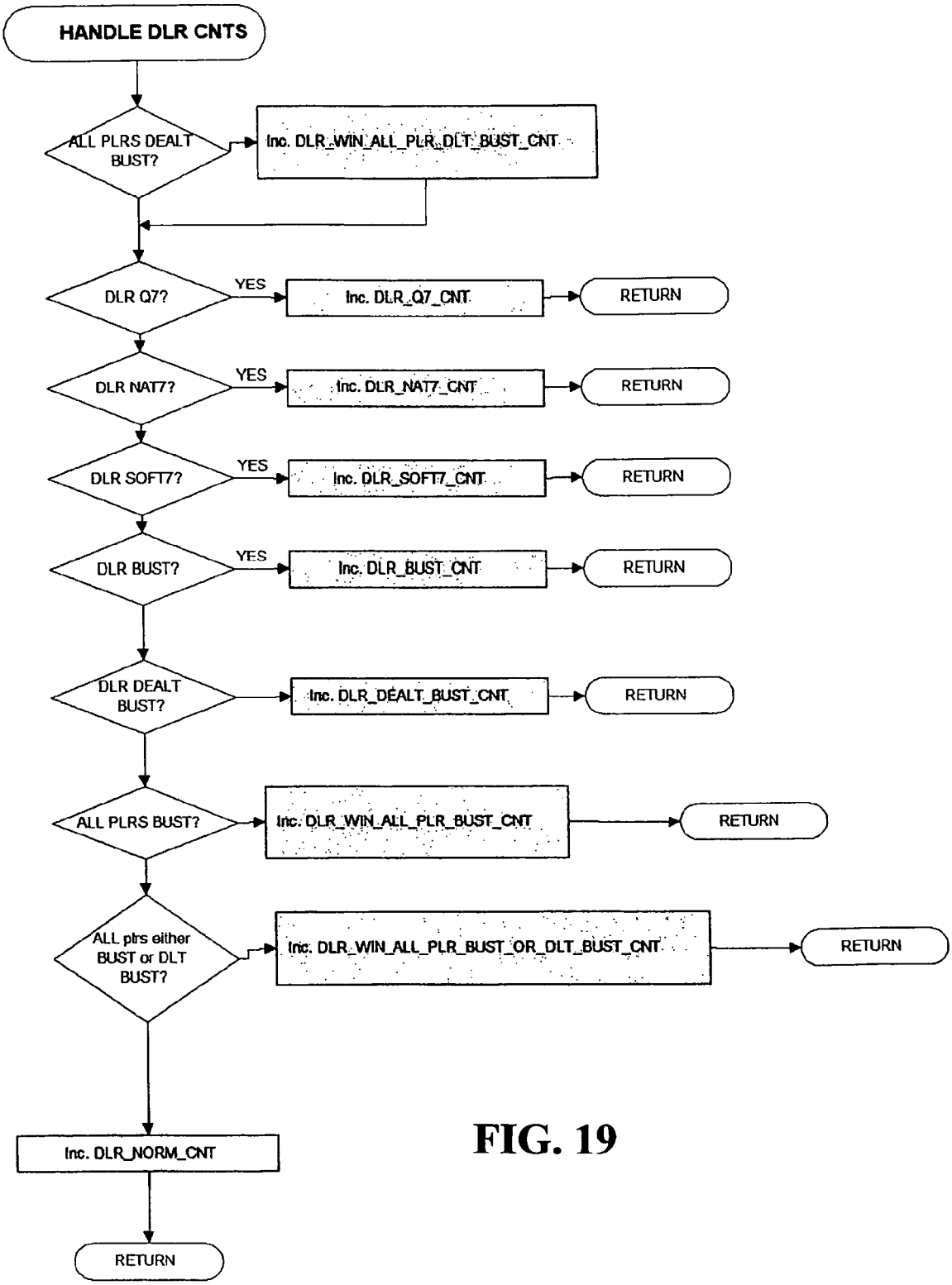
FIG. 19 is a flow chart for an exemplary computer-implemented method for an example of the game where the target number is seven, the method handling a Dealer hand in view of player results, and incrementing associated counters.

FIG. 4 is a flowchart of a method 90 of implementing a game in a manner suitable for implementation in an automated system such as a computer, video slot, network, etc., according to an exemplary embodiment of the invention. FIGS. 5-14 respectively show exemplary flow charts for computer-implemented methods, including method 100 for dealing a hand to each player and the Dealer, method 110 for dealing a card, method 120 for shuffling, method 130 for discarding, method 140 for playing a hand as an Average player, method 150 for playing a hand as a Conservative player, method 160 for playing a hand as a Risky player, method 170 for playing a Dealer hand, method 180 for analyzing the results of a hand, and method 190 for implementing any of three predefined player profiles. The example shown would be fully understood by one of skill in the art as being adaptable to various combinations of sequential, combinational, and object-oriented programs, and other schemes of implementation. Such schemes will depend on platforms and hardware being used, and may incorporate features such as media interaction tools and displays, automated accounting, player identification, security tools, and others. Details of the various method steps are omitted because such are self-explanatory and because the variable names of the example are self-descriptive. One skilled in the art would be able to implement a computer application from the illustrated flow charts.

Various accessory and optional routines may be implemented, and programs may be designed for ease of updating, use of predefined functions, etc. For example, a randomization function may be supplemented with additional randomization programs, where a resulting program may be implemented as a new function or variable. In another example, a unique player profile may be maintained and updated for a particular player, and combinations of players may be sorted according to their respective profiles. Such player profiles may be assembled according to histories of player activity, and the profiles may be integrated in a well-designed program.

Although the various embodiments are described in terms of a shuffling and a dealing of cards to individual player hands, the game is not limited to such a scenario. For example, a player hand may alternatively be chosen by a separate method, such as from a selection of displayed first cards. In another example, a player hand may be chosen according to elements of a player's profile. Many other variations are possible for effecting a game.

FIGS. 15-19 respectively show flow charts for exemplary computer-implemented methods for an example of the above-described game of QUICK SEVEN, including method 200 for handling a player hand that is a Quick Seven and that accounts for player Bonus wagers and for possible Dealer hands, method 210 for handling a player hand that is a Natural seven, method 220 for handling a player hand that is a Soft seven, method 230 for handling a player hand that is a Bust and including a routine for handling a Hazard Bet by the player, and method 240 for handling a Dealer hand in view of player results, and incrementing associated counters.

It will be understood by those skilled in the art that numerous applications may be implemented for playing a game of the present invention. For example, the game is adaptable for being played in a system of gaming devices networked for remote play, such as a system being disclosed in U.S. application Ser. No. 10/913,301 by Saunders et al., incorporated herein by reference. In another example, the game may be implemented for various participants in multiplayer online electronic games, such as where players may host and join new instances of multiplayer online electronic games including those already in progress, and such as where a method is implemented through a gaming utility that runs on each player's electronic device and interacts behind the scenes with an online messaging service, such systems being disclosed in U.S. application Ser. No. 11/090,826 by Danieli et al., incorporated herein by reference. Other implementations of the game are envisaged, such as those having random event generators, those including distributed methods, those using wireless protocols, those combined with other programs such as advertising, those having user verification routines and processes, and others.

Figure 20:
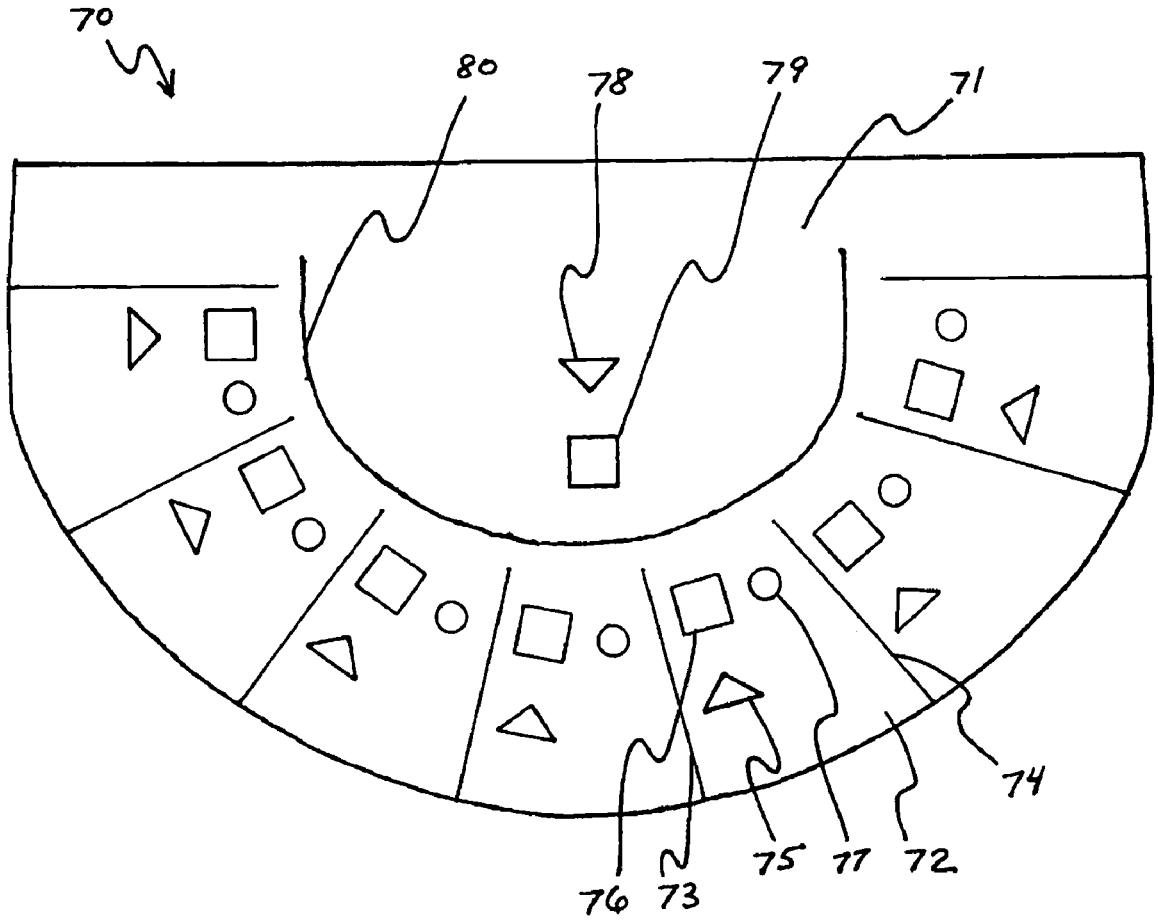
FIG. 20 is a schematic top view of a casino type table area used for playing a game according to an exemplary embodiment of the invention.

FIG. 20 is an exemplary top schematic view of a casino table playing area 70. In this example, playing area 70 has one Dealer area 71 and seven player areas 72 that accommodate up to seven corresponding players. The Dealer area 71 has a Dealer hand area 78 and a Dealer Discard area 79. Each player area 72 has a player hand area 75, a player Discard area 76, and a player wager location 77. Each player area 72 is preferably marked with a left borderline 73 and a right borderline 74. Playing area 70 may be a part of a larger table top, such as a table having a lower border area (not shown) that may be used by players for resting their elbows, holding drinks and ashtrays, etc. Playing area 70 may be implemented as a template formed to be placed on top of an existing blackjack table, or it may be formed as its own table. For example, playing area 70 may have structure for holding itself firmly in place by using pins that pass through holes in such template and into the blackjack table. In another example, playing area 70 may have elastic straps or the like, or may be a replaceable section of felt or other replacement tabletop, etc. By providing a modular, interchangeable, or covering type structure for playing area 70, existing blackjack tables can be used for either game.

While the principles of the invention have been shown and described in connection with specific embodiments, it is to be understood that such embodiments are by way of example and are not limiting. Consequently, variations and modifications commensurate with the above teachings, and with the skill and knowledge of the relevant art, are within the scope of the present invention. The embodiments described herein are intended to illustrate best modes known of practicing the invention and to enable others skilled in the art to utilize the invention in such, or other embodiments and with various modifications required by the particular application(s) or use (s) of the present invention. It is intended that the appended claims be construed to include alternative embodiments to the extent permitted by the prior art.

What is claimed is:

1. A method of playing a card game with a Dealer and at least one player, the game using at least one deck of standard playing cards, the method comprising the steps of: designating a target number acheivable by one card; dealing a hand of a first card to each player and a card to the Dealer; playing each player's hand where each player and the Dealer has an objective of achieving for her respective hand a value equal to the target number; if a player's first card is less than the target number, dealing additional cards to that hand until a total of the hand is greater than or equal to the target number; if a player's first card is greater than the target number, dealing a second card to that hand; allowing one Discard, wherein all face cards and aces have respective values of one, and wherein jokers are not used.

2. The method of claim 1, wherein each player must make a wager, and wherein a player hand having a first-received card equal to the target number receives a Bonus payout immediately upon receipt of the first-received card.

3. The method of claim 2, wherein each player receiving the Bonus payout may Press such Bonus payout as an additional wager on the hand.

4. The method of claim 2, wherein the Bonus is a percentage of the wager of the corresponding player receiving the Bonus.

5. The method of claim 1, wherein each player has a further objective, when a respective first-received card of her hand is not the target number, of achieving for her hand a value closest to the target number without exceeding the target number.

6. The method of claim 5, wherein each player having a hand with a value less than the target number, after a Discard, may elect to Hit one additional card at a time so long as the hand is less than the target number.

7. A method of playing a card game with a Dealer and at least one player, the game using at least one deck of standard playing cards, the method comprising the steps of: designating a target number acheivable by one card; placing a wager by each player; dealing a hand of a first card to each player and a card to the Dealer; playing each player's hand where each player and the Dealer has an objective of achieving for her respective hand a value equal to a predetermined target number obtainable by one card, allowing one Discard, wherein for each hand with a first-received card that is not the target number, the method further comprises dealing as many additional card(s) as necessary to achieve a hand value greater than or equal to the target number, prior to the Discard.

8. The method of claim 7, wherein any hand with a value greater than or equal to the target number, after the Discard, is a Bust hand.

9. The method of claim 8, further comprising providing any player with a Bust hand the option of wagering an additional amount on the likelihood of a Dealer Bust.

10. A method of playing a card game with a Dealer and at least one player, the game using at least one deck of standard playing cards, the method comprising the steps of:

(a) designating a target number achievable by one card;

(b) dealing a hand of a first face-up card to each player and a face-down card to the Dealer;

(c) if a player's first face-up card is less than the target number, dealing additional face-up cards to that hand until a total of the hand is greater than or equal to the target number;

(d) if a player's first face-up card is greater than the target number, dealing a second face-up card to that hand;

(e) discarding one card from each player's hand having a total greater than the target number;

(f) analyzing all resultant player hands, where:

(f1) a hand having a total greater than the target number after a discard has been made is a Bust;

(f2) a player's hand having a total less than the target number may Hit so long as that hand's total is less than the target number; and (f3) a hand having a total equal to the target number must Stand;

(g) dealing as many face-up Hit cards as requested to any player's hand meeting (f2);

(h) turning the Dealer card face up and addressing the Dealer hand according to steps (c-e) and, in addition, requiring the Dealer to Hit when the Dealer hand total is less than or equal to a predetermined threshold number, and requiring the Dealer to Stand when the Dealer hand total is greater than the predetermined threshold number; and (i) determining a winner between each player hand and the Dealer hand, wherein face cards and aces each have a value of one and numbered cards each have a value equal to their respective number, and wherein a post-discard hand value greater than the target number is a Bust.

11. The method of claim 10, wherein in step (i) the Dealer wins when a final value of the Dealer hand is greater than or equal to a final value of a player's hand.

12. The method of claim 10, wherein the target number is seven and wherein the predetermined threshold number is four.

13. The method of claim 10 further comprising (j) paying an amount to each winning player based on that player's wager.

14. The method of claim 10 wherein a first face-up card that matches the target number is designated a "Quick," and wherein a player who wins a hand with a Quick is eligible for a bonus amount.

15. The method of claim 14, wherein the player having a Quick hand has the option of increasing her present wager by the bonus amount or receiving the bonus amount as a payout.

16. The method of claim 10 further comprising (j) when a player's hand is a Bust resulting from two consecutive cards each exceeding the target number, giving that player the option to wager an additional amount, where a Dealer Bust hand results in that player winning her original wager plus the additional amount.

17. The method of claim 10, wherein the target number is seven and wherein the Dealer must stand on five or higher after a discard.

18. The method of claim 17, wherein the Dealer has to Hit on four or lower.

19. A method of playing a card game with a Dealer and at least one player, using at least one deck of standard playing cards having no jokers, the method comprising:

(a) designating a target number achievable by one card;

(b) dealing a hand of a single face-up card to each player and a single face-down card to the Dealer;

(c) analyzing all player hands from step (b), where:

(c1) any hand that matches the target number is designated a "Quick";

(c2) any hand less than the target number is eligible for a Hit; and (c3) any hand greater than the target number requires a discard and a Hit;

(d) allowing each hand eligible for a Hit to receive as many Hits as requested so long as that hand's total is less than the target number;

(e) allowing each hand having a total greater than the target number to discard one card, with a maximum one discard per hand;

(f) resolving all player hands according to steps (c-e);

(g) turning the Dealer card face up and resolving the Dealer hand according to steps (c1-e); and (h) determining a winner between each player hand and the Dealer hand, wherein face cards and aces each have a value of one and numbered cards each have a value equal to their respective number, and wherein a post-discard hand value greater than the target number is a Bust.

20. A method of playing a wagering card game with a Dealer and at least one player who has made a wager, the game using at least one deck of standard playing cards having no jokers wherein all face cards and aces have respective values of one, the method comprising the steps of: designating a target number acheivable by one card; placing a wager by each player; dealing a hand of a first card to each player and a card to the Dealer if a player's first card is less than the target number, dealing additional cards to that hand until a total of the hand is greater than or equal to the target number; if a player's first card is greater than the target number, dealing a second card to that hand; when a player's hand is greater than the target number, giving that player the option to wager an additional amount, where a subsequent Dealer hand having a total that is greater than the target number results in that player winning her original wager plus the additional amount.

21. The method of claim 20, wherein when a player's hand consists of two consecutive cards each exceeding a predetermined target number that player's hand is a Bust hand.

22. A method of playing a wagering card game with a Dealer and at least one player who has made a wager, the game using at least one deck of standard playing cards, the method comprising the steps of:

designating a target number achievable by one card;

placing a wager by each player; dealing a hand of a first card to each player;

if a first card of each player's hand is less than the target number, dealing additional face-up cards to that hand until the total is greater than or equal to the target number; and requiring that each player discard one card when that player's hand has a total that exceeds the target number.

23. The method of claim 22, further comprising:

when a player's hand is greater than the target number, giving that player the option to wager an additional amount, where a subsequent Dealer Bust hand having a total that is greater than the target number results in that player winning her original wager plus the additional amount, whereby each player is afforded at least one opportunity to maintain a wager in every possible hand.

24. A method of playing a card game with a Dealer and at least one player, the game using at least one deck of standard playing cards, the method comprising the steps of:

dealing a hand of a first face-up card to each player and a face-down card to the Dealer; and dealing at least one additional card to each hand unless the corresponding hand has a value of a target number achievable by one card;

wherein the objective of the card game is to achieve a hand with a value of the target number, allowing one discard, and wherein face cards and aces each have a value of one and numbered cards each have a value equal to their respective number, and wherein a post-discard hand value greater than the target number is a Bust.

25. The method of claim 24, further comprising selecting the target number by choosing one card from a group of numbered cards.

26. The method of claim 25, wherein the choosing is by a random process.

27. The method of claim 25, wherein the choosing is directed by one player.

* * * * *

UNITED STATES PATENT AND TRADEMARK OFFICE

CERTIFICATE OF CORRECTION

PATENT NO. : 7,407,162 B2
APPLICATION NO. : 11/224261
DATED : August 5, 2008
INVENTOR(S) : Larry R. Cockrell, Jr.

It is certified that error appears in the above-identified patent and that said Letters Patent is hereby corrected as shown below:

Column 16, line 22, after “Dealer”, delete “Bust”.

Signed and Sealed this

Twelfth Day of May, 2009

JOHN DOLL
*Acting Director of the United States Patent and Trademark Office*